US010480321B2

(12) United States Patent
Bailey et al.

(10) Patent No.: US 10,480,321 B2
(45) Date of Patent: Nov. 19, 2019

(54) ATTACHMENT OF PILOTING FEATURE

(71) Applicant: Rolls-Royce Corporation, Indianapolis, IN (US)

(72) Inventors: Patrick E. Bailey, Plainfield, IN (US); Samuel J. Lacombe, Indianapolis, IN (US); Eric W. Engebretsen, Zionsville, IN (US); Rodney D. Conrad, Zionsville, IN (US); Matthew J. Kappes, Greenwood, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 890 days.

(21) Appl. No.: 14/944,278

(22) Filed: Nov. 18, 2015

(65) Prior Publication Data

US 2016/0160688 A1 Jun. 9, 2016

Related U.S. Application Data

(60) Provisional application No. 62/088,145, filed on Dec. 5, 2014.

(51) Int. Cl.
*F01D 5/06* (2006.01)

(52) U.S. Cl.
CPC ..... *F01D 5/066* (2013.01); *F05D 2220/32* (2013.01); *F05D 2220/36* (2013.01); *F05D 2230/60* (2013.01); *F05D 2230/642* (2013.01); *F05D 2240/20* (2013.01); *F05D 2260/38* (2013.01)

(58) Field of Classification Search
CPC ..... F01D 5/02; F01D 25/28; F04D 29/329; Y10T 403/64; Y10T 403/642; Y10T 403/645
See application file for complete search history.

(56) References Cited

U.S. PATENT DOCUMENTS

| | | | | |
|---|---|---|---|---|
| 3,754,766 | A | 8/1973 | Asplund | |
| 4,502,809 | A | 3/1985 | Geary | |
| 4,834,569 | A | 5/1989 | Foote et al. | |
| 4,975,014 | A | 12/1990 | Rufin et al. | |
| 5,108,259 | A | 4/1992 | Nakeman et al. | |
| 5,333,993 | A | 8/1994 | Stueber et al. | |
| 5,451,116 | A | 9/1995 | Czachor et al. | |
| 5,592,814 | A * | 1/1997 | Palusis | F02K 1/80 60/753 |

(Continued)

FOREIGN PATENT DOCUMENTS

| | | | |
|---|---|---|---|
| EP | 1734305 | A2 | 12/2006 |
| WO | 2010024736 | A1 | 3/2010 |
| WO | 2014046965 | A1 | 3/2014 |

OTHER PUBLICATIONS

Extended European Search Report, European Application No. 15196648.8-1610, dated Jul. 14, 2016, 9 pages.

*Primary Examiner* — David E Sosnowski
*Assistant Examiner* — Cameron A Corday
(74) *Attorney, Agent, or Firm* — Barnes & Thornburg LLP

(57) ABSTRACT

A fan assembly for use in a gas turbine engine of an aircraft includes a fan disk having a number of fan blades and a windage shield coupled to the fan disk to move therewith. The fan assembly supplies air for use in the engine. The windage shield rotates with the fan disk during operation of the gas turbine engine and directs air supplied by the fan blade.

16 Claims, 17 Drawing Sheets

(56) References Cited

U.S. PATENT DOCUMENTS

| | | | | |
|---|---|---|---|---|
| 5,662,457 | A | 9/1997 | Bechtel et al. | |
| 5,846,050 | A | 12/1998 | Schilling | |
| 6,102,610 | A | 8/2000 | Palusis et al. | |
| 6,672,786 | B2 | 1/2004 | Schenk | |
| 6,726,391 | B1 | 4/2004 | Kreis et al. | |
| 6,896,483 | B2 | 5/2005 | Dierksmeier et al. | |
| 7,153,054 | B2 * | 12/2006 | Arbona | B62D 29/048 403/28 |
| 7,258,541 | B2 | 8/2007 | Novo | |
| 7,849,696 | B2 * | 12/2010 | De Sousa | F23R 3/60 60/753 |
| 8,147,178 | B2 | 4/2012 | Ottaviano et al. | |
| 8,434,999 | B2 | 5/2013 | Amaral et al. | |
| 8,459,941 | B2 | 6/2013 | Jasko et al. | |
| 8,556,561 | B2 | 10/2013 | Norton | |
| 2008/0193201 | A1 | 8/2008 | Kwan et al. | |
| 2013/0223982 | A1 | 8/2013 | Durocher et al. | |

* cited by examiner

ATTACHMENT OF PILOTING FEATURE

CROSS-REFERENCE TO RELATED APPLICATION

This application claims the benefit of and priority to U.S. Provisional Patent Application Ser. No. 62/088,145, filed Dec. 5, 2014, which is incorporated herein by this reference in its entirety.

FIELD OF THE DISCLOSURE

The present disclosure relates generally to gas turbine engines and more specifically to attachment of gas turbine engine components.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Gas turbine engines used in aircraft may include a fan assembly that is driven by the turbine to push air through the engine and provide thrust for the aircraft. A typical fan assembly includes a fan disk having blades and a fan case that extends around the blades of the fan disk. During operation, the fan blades of the fan disk are rotated to push air through the engine. The fan case guides the air pushed by the fan blades.

The fan assembly may further include a windage shield coupled to the fan disk to assist in guiding air through the engine. The windage shield may be positioned to block entry of high pressure air into ambient environments within the gas turbine engine. Harmful stresses may form in the windage shield during operation of the gas turbine engine. These stresses may result from high rotational speeds of the fan assembly or from differences in thermal and mechanical expansion rates between the windage shield and the fan disk.

SUMMARY

The present disclosure may comprise one or more of the following features and combinations thereof.

A gas turbine engine may include a first component, a second component coupled to the first component to move therewith, and an anchor arranged to interconnect and couple the first component to the second component. The first component may be formed to include a first anchor-receiving space therein, the anchor-receiving space being arranged to extend along an installation axis through a portion of the first component. The second component may be formed to include a second anchor-receiving space therein, and the second anchor-receiving space is arranged to extend along the installation axis through the second component and be aligned with the first anchor-receiving space.

The anchor may include a bushing, a washer, a fastener, and a fastener retainer. The bushing may be located in the second anchor-receiving space and arranged to extend out of the anchor receiving space toward the first component to engage the first component. The washer may be positioned to engage the bushing along the installation axis to locate the second anchor-receiving space between the washer and the first component. The fastener may be arranged to extend through a fastener-receiving aperture formed in the washer, through a fastener-receiving space formed in the bushing, and through the first anchor-receiving space. The fastener retainer may be coupled to the fastener to block movement of the fastener relative to the first and second components while locating the second component and the bushing between the fastener retainer and the washer. The anchor may be configured to provide means for minimizing stress formed in the fastener during operation of the gas turbine engine as a result of the first component having a different thermal or mechanical expansion rate than the second component.

In some embodiments, the anchor may be further configured to provide means for minimizing fretting between the first component and the second component during operation of the gas turbine engine as a result of the first component having a different thermal or mechanical expansion rate than the second component.

In some embodiments, a portion of the second component is formed to include the second anchor-receiving space and the portion of the second component is spaced apart axially from the first component.

In some embodiments, a thickness of the portion of the second component is smaller than a length of the bushing such that the portion of the second component is spaced apart from the first component when the second component is coupled to the first component.

In some embodiments, the anchor may further include an insert located in the second anchor-receiving space and arranged to engage the second component, the insert including a bushing-receiving space and a washer-engaging surface, the bushing-receiving space arranged to surround an outer surface of the bushing and the washer-engaging surface positioned to engage the washer to space the washer from the second component.

In some embodiments, the bushing-receiving space may be defined by an inner surface arranged to face toward the installation axis and the outer surface of the bushing is spaced-apart from the inner surface by a first distance when the gas turbine engine is at a cold temperature.

In some embodiments, the outer surface of the bushing may be spaced-apart from the inner surface by a relatively smaller second distance when the gas turbine engine is at a relatively greater operational temperature.

In some embodiments, the outer surface of the bushing may be spaced-apart from the inner surface by a third distance relatively smaller than the first distance while the gas turbine engine transitions from the operational temperature to the cold temperature.

In some embodiments, the bushing may include a sleeve arranged to pass into the second anchor-receiving space of the second component and a flange coupled to the sleeve arranged to contact the first component.

In some embodiments, the second component may further include a recess formed into the second component at one end of the second anchor-receiving space, the recess being sized and arranged to surround the flange of the bushing.

In some embodiments, the second anchor-receiving space may be defined by an inner surface arranged to face toward the installation axis and an outer surface of the bushing is spaced-apart from the inner surface by a first distance when the gas turbine engine is at a cold temperature.

In some embodiments, the outer surface of the bushing may be spaced-apart from the inner surface by a relatively smaller second distance when the gas turbine engine is at a relatively greater operational temperature.

In some embodiments, the outer surface of the bushing may be spaced-apart from the inner surface by a third distance relatively smaller than the first distance while the gas turbine engine transitions from the operational temperature to the cold temperature.

In illustrative embodiments, the bushing and the washer are formed as a single unitary component.

In illustrative embodiments, the bushing, the washer, and the fastener are formed as a single unitary component.

According to another aspect of the present disclosure, a process of coupling a first component to a second component in a gas turbine engine may include the steps of aligning a first component with a second component, contacting a first portion of the second component against the first component while a second portion of the second component is spaced apart from the first component, biasing the second portion of the second component toward the first component to place an axial load on the second component relative to the first component, and maintaining the axial load at a substantially constant level while radial loads placed on the second component vary during operation of the gas turbine engine.

In some embodiments, the aligning step may include aligning an anchor-receiving space formed in the first component with an anchor-receiving space formed in the second component along an installation axis, aligning a bushing with the installation axis to extend into the anchor-receiving space of the second component, aligning a washer with the installation axis to engage the second component and bushing, aligning a fastener with the installation axis to extend through the washer, bushing, and anchor-receiving space of the first component and engage the washer, and aligning a fastener retainer with the installation axis to engage the fastener and first component to couple the second component to the first component.

In some embodiments, the biasing step may include engaging the fastener with the fastener retainer to engage the washer with the second component and bias the second portion of the second component toward the first component to place the axial load on the second component relative to the first component, engaging the fastener with the fastener retainer to engage the washer with the bushing and engage the bushing with the first component to place an axial load on the bushing relative to the first component to maintain the axial load on the second component, and engaging the fastener with the fastener retainer to place a relatively greater axial load on the fastener than the axial load on the second component.

In some embodiments, the aligning step may further include aligning an insert with the installation axis to extend into the anchor-receiving space of the second component, surround an outer surface of the bushing, and engage the second component. The biasing step may further include engaging the fastener with the fastener retainer to engage the washer with the insert to engage the insert with the second component and bias the second portion of the second component toward the first component to place the axial load on the second component relative to the first component.

According to another aspect of the present disclosure, a gas turbine engine may include a fan disk arranged to hold a plurality of fan blades for rotation about a central axis of the gas turbine engine, a windage shield arranged to guide incoming air provided by the fan blades through the gas turbine engine, and an anchor arranged to interconnect and couple the windage shield to the fan disk. The fan disk may be formed to include a first anchor-receiving space therein arranged to extend along an installation axis through a portion of the fan disk. The windage shield may be coupled to the fan disk to move therewith and be formed to include a second anchor-receiving space therein. The second anchor-receiving space may be arranged to extend along the installation axis through the windage shield and be aligned with the first anchor-receiving space.

The anchor may include a bushing, a washer, a fastener, and a fastener retainer. The bushing may have a sleeve located in the second anchor-receiving space and a flange coupled to the sleeve arranged to extend out of the second anchor-receiving space toward the fan disk to engage the fan disk. The washer may be positioned to engage the bushing along the installation axis to locate the second anchor-receiving space between the washer and the fan disk. The fastener may be arranged to extend through a fastener-receiving aperture formed in the washer, through a fastener-receiving space formed in the bushing, and through the first anchor-receiving space. The fastener retainer may be coupled to the fastener to block movement of the fastener relative to the fan disk and windage shield while locating the windage shield and the bushing between the fastener retainer and the washer. A length of the bushing may be longer than a length of the second anchor-receiving space and a diameter of the sleeve may be smaller than a diameter of the second anchor-receiving space such that the second anchor-receiving space is spaced apart from the fan disk and the sleeve is spaced apart from an inner surface of the second anchor-receiving space to allow the windage shield to expand and contract relative to the fan disk while minimizing stresses in the fastener during operation of the gas turbine engine.

In some embodiments, the anchor may further include an insert, the insert including a tube located in the second anchor-receiving space and a flange coupled to the tube and arranged to engage the windage shield and extend out of the second anchor-receiving space toward the washer to engage the washer. A length of the bushing may be longer than a length of the second anchor-receiving space and an outer diameter of the sleeve is smaller than an inner diameter of the tube such that the second anchor-receiving space is spaced apart from the fan disk and the sleeve is spaced apart from an inner surface of the tube to allow the windage shield to expand and contract relative to the fan disk while minimizing stresses in the fastener during operation of the gas turbine engine.

In some embodiments, the outer surface of the sleeve may be spaced-apart from the inner surface of the tube by a first distance when the gas turbine engine is at a cold temperature. The outer surface of the sleeve may be spaced-apart from the inner surface of the tube by a relatively smaller second distance when the gas turbine engine is at a relatively greater operational temperature. The outer surface of the sleeve may be spaced apart from the inner surface of the tube by a third distance relatively smaller than the first distance while the gas turbine engine transitions from the operational temperature to the cold temperature.

These and other features of the present disclosure will become more apparent from the following description of the illustrative embodiments.

DETAILED DESCRIPTION OF THE DRAWINGS

Figure 1:
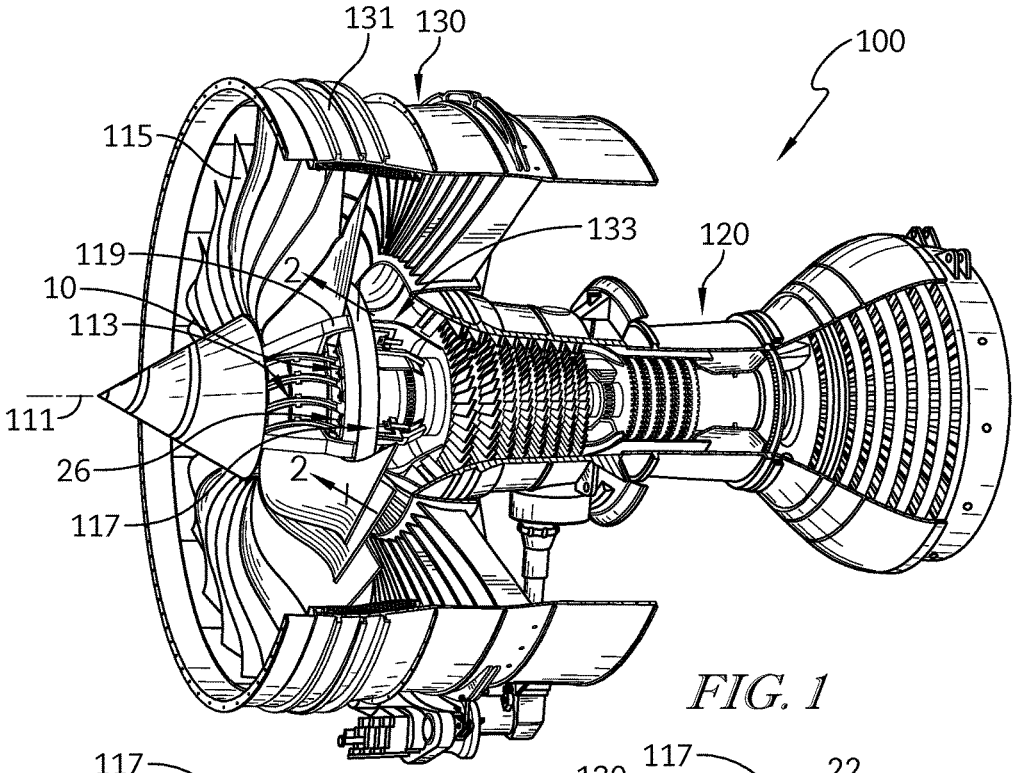
FIG. 1 is a perspective view of a gas turbine engine with portions broken away showing that the gas turbine engine includes fan blades attached to a fan disk and a windage shield coupled to the fan disk by a plurality of component anchors for rotation about a central axis of the gas turbine engine.

For the purposes of promoting an understanding of the principles of the disclosure, reference will now be made to a number of illustrative embodiments illustrated in the drawings and specific language will be used to describe the same.

First Aspect Of The Disclosure

An illustrative gas turbine engine 100 used in aircraft includes a fan assembly 130 driven by an engine core 120 to push air through the engine 100 and provide thrust for the aircraft as suggested in FIG. 1. The illustrative fan assembly 130 includes a fan disk 113, also called a first component 113, having a number of fan blades 115, a fan case 131 that extends around the fan blades 115 of the fan disk 113, a static vane assembly 133 for directing air through the engine 100, and a windage shield 117, also called a second component 117, coupled between the fan disk 113 and static vane assembly 133. A number of flow guides 119 are secured to the fan disk 113 between the fan blades 115 to force incoming air outwards toward the windage shield 117.

Figure 2:
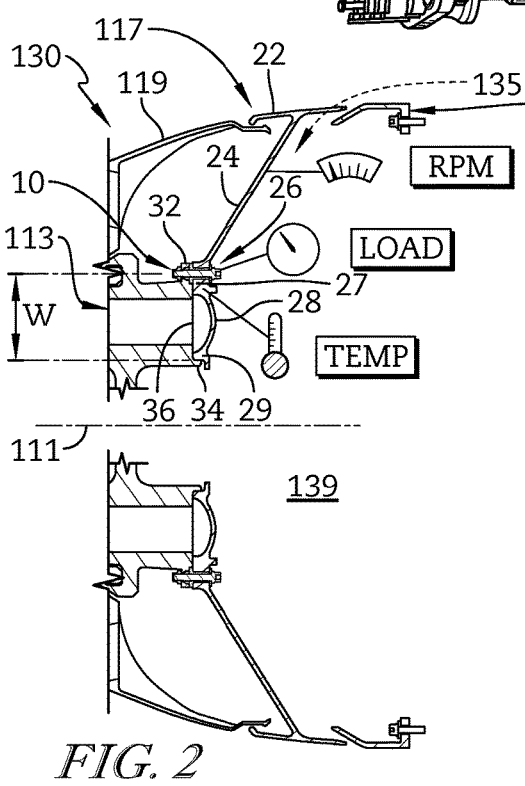
FIG. 2 is an enlarged cross-sectional view of the fan disk and windage shield of FIG. 1 showing that the component anchors interconnect the windage shield to the fan disk to rotate therewith and suggesting that a pilot anchor of the windage shield is held against a pilot receiver of the fan disk at a distance from the component anchor (W) and there is a low radial load on the component anchor when there is a low temperature and low rotational speed of the fan disk and windage shield.
Figure 3:
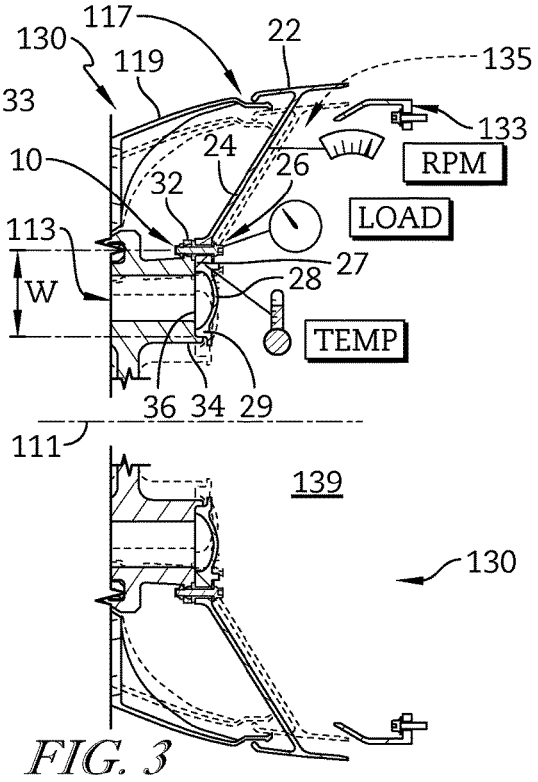
FIG. 3 is a view similar to FIG. 2 suggesting that the pilot anchor remains in contact with the pilot receiver at substantially the same distance from the component anchor (W) and the radial load on the anchor remains low as the fan disk radially expands relative to the windage shield with rising temperature and rotational speed of the fan disk and windage shield.
Figure 4:
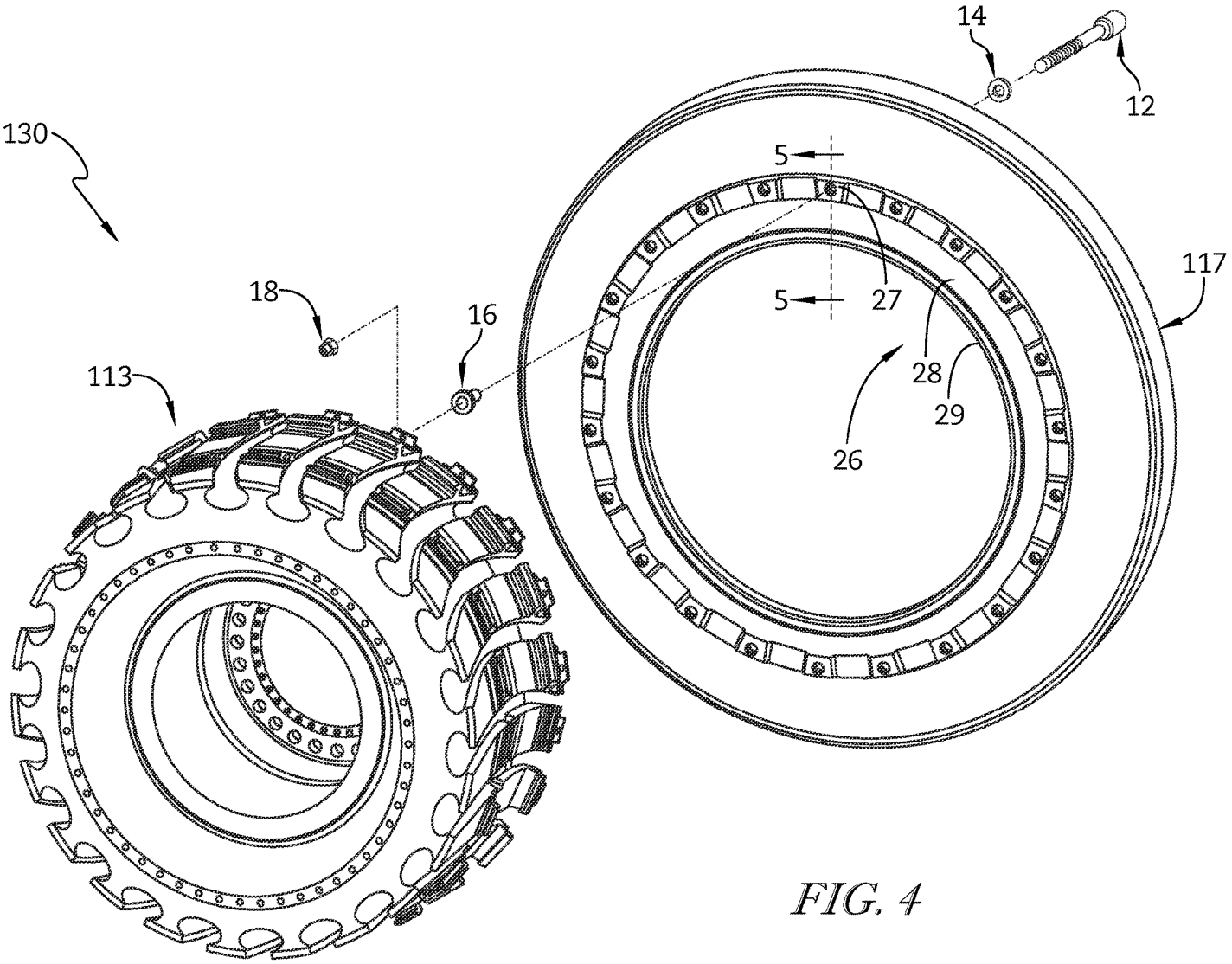
FIG. 4 is an exploded assembly view of the fan disk and windage shield of FIG. 1 showing one embodiment of a pilot unit of the windage shield in accordance with the present disclosure and suggesting that the pilot unit includes the pilot anchor, a pilot mount, and a bias link interconnecting the pilot anchor and pilot mount.

The windage shield 117 is coupled to the fan disk 113 by one or more component anchors 10 for rotation about a central axis 111 of the engine 100 as suggested in FIGS. 2 and 3. The windage shield 117 includes an outer annular shield wall 22, a radially extending support wall 24 coupled to the shield wall 22, and a pilot unit 26 coupled to the support wall 24. The shield wall 22 is positioned to span a gap 135 between the flow guides 119 and static vane assembly 133. The shield wall 22 blocks incoming air passing over the flow guides 119 from passing through the gap 135 and entering an ambient environment 139 within the engine 100. The incoming air instead passes over the shield wall 22 and over the static vane assembly 133 to other areas of the engine 100, such as the engine core 120. The support wall 24 couples the shield wall 22 to the pilot unit 26 and positions the shield wall 22 over portions of the flow guides 119 and static vane assembly 133 so that the incoming air may flow over the shield wall 22.

The fan disk 113 and windage shield 117 radially expand as the rotational speed and temperature of the gas turbine engine 100 increases as shown in FIG. 3. The static vane assembly 134 remains at a substantially constant radius from the axis of rotation 111. However, it should be noted that variations in the radius of the static vane assembly 134 may occur due to changes in temperature within the gas turbine engine 100. As such, an opening may be formed between the shield wall 22 of the windage shield 117 and static vane assembly 134 which allows gases trapped in the ambient environment 139 to escape through the gap 135 and into other sections of the engine 100.

In one illustrative embodiment, the pilot unit 26 includes a pilot mount 27 coupled to the support wall 24, a bias link 28 coupled to the pilot mount 27 and extending radially inward from the pilot mount 27, and a pilot anchor 29 coupled to the bias link 28 as shown in FIGS. 2-3. The pilot unit 26 cooperates with the fan disk 113 to align rotation of the windage shield 117 with the fan disk 113. The component anchors 10 pass through the pilot mount 27 and through flanges 32 of the fan disk 113 to couple the windage shield 117 to the fan disk 113. A radially extending wall 36 and pilot receiver 34 of the fan disk 113 cooperate with the pilot mount 27 of the windage shield 117 to align the windage shield 117 with the fan disk 113.

Figure 5:
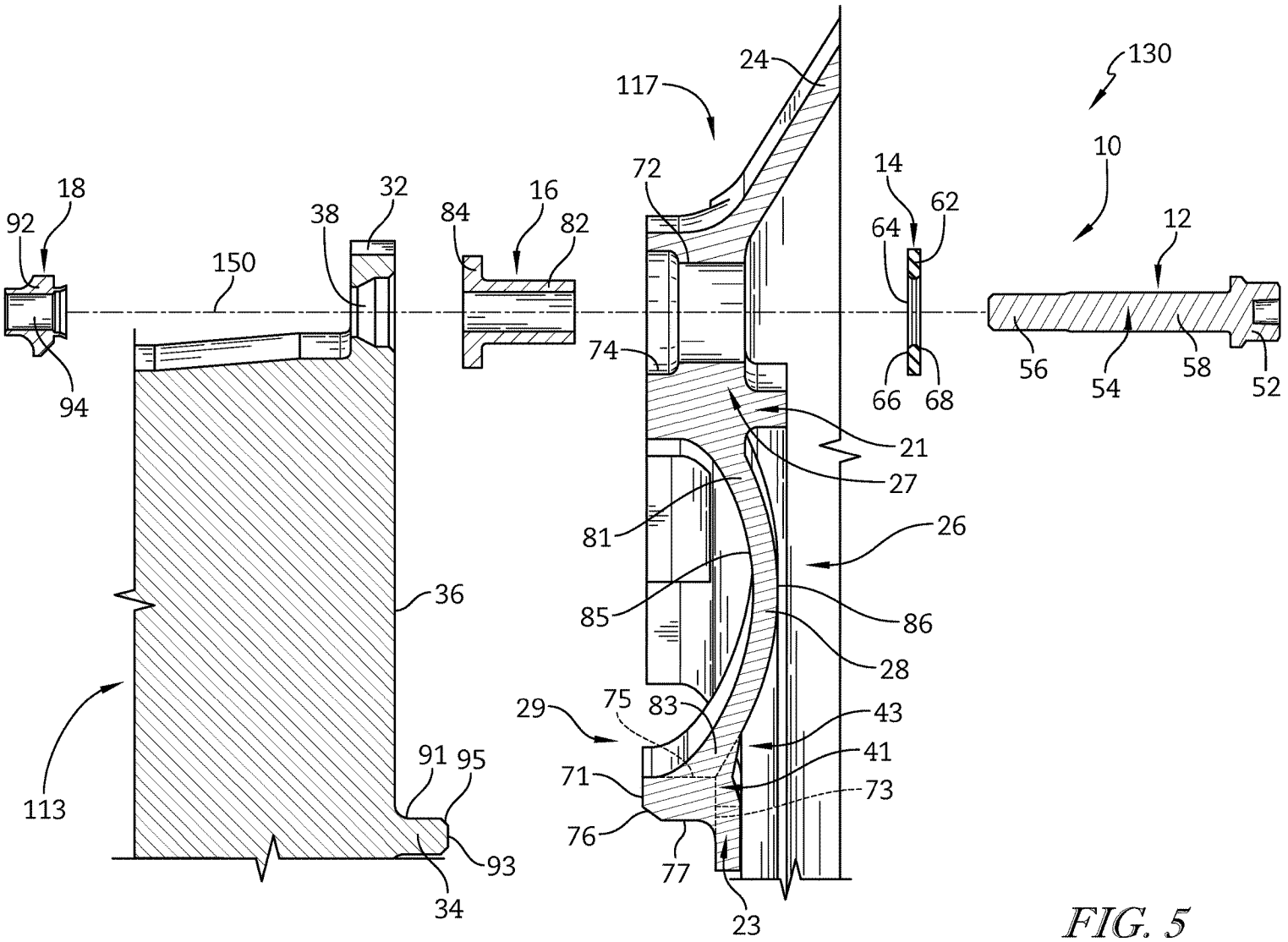
FIG. 5 is an exploded cross-sectional view of the assembly of FIG. 4 showing one embodiment of a component anchor in accordance with the present disclosure and suggesting that the pilot anchor is positioned to engage with the pilot receiver to align the windage shield with the fan disk and that the component anchor includes, from left to right, a fastener retainer, a bushing, a washer, and a fastener.

The bias link 28 includes a first end 81 coupled to the pilot mount 27, a second end 83 coupled to the pilot anchor 29, a first curved surface 85 extending between the first and second ends 81, 83, and a second curved surface 86 spaced apart from the first curved surface 85 and extending between the first and second ends 81, 83 as shown in FIG. 5. The bias link 28 assumes a generally curved shape with the curve extending away from the fan disk 113. However, any other suitable shape may be used. The pilot unit 26 further includes an outer tab 21 coupled to the pilot mount 27 and extending axially outward therefrom. The first end 81 of the bias link 28 is coupled to the pilot mount 27 and outer tab 21. However, the first end 81 is coupled to the pilot mount 27 alone. In one embodiment, the outer tab 21 is a balance land where portions are machined away to balance the windage shield 117 for rotation.

The pilot anchor 29 includes a radially-extending contact surface 71, a radially-extending support surface 73 spaced apart from the contact surface 71, an axially-extending coupler surface 75 coupled between the contact and support surfaces 71, 73, an axially-extending mount surface 77 spaced apart from the coupler surface 75 and coupled to the support surface 73, and a bevel surface 76 coupled between the contact surface 71 and mount surface 77 as shown in FIG. 5. The second end 83 of the bias link 28 is coupled to the coupler surface 75. In the illustrative embodiment, the pilot anchor 29 further includes an inner tab 23 coupled to the support surface 73 and a pilot support 41 coupled between the bias link 28 and inner tab 23. The pilot support 41 forms a channel 43 between the bias link 28 and inner tab 23. In one embodiment, the inner tab 23 is a removal feature allowing the windage shield 117 to be pried off of the fan disk 113.

The pilot receiver 34 of the fan disk 113 includes a receiver surface 91 extending axially from the wall 36, a radially-extending end surface 93, and an angled guide surface 95 coupled between the receiver surface 91 and end surface 93 as shown in FIG. 5. In the illustrative embodiment, the mount surface 77 of the pilot anchor 29 and the receiver surface 91 of the pilot receiver 34 are positioned at substantially the same radial distance from the central axis 111 of the engine 100 such that the mount surface 77 mates with the receiver surface 91 to align the windage shield 117 with the fan disk 113 as suggested in FIG. 6. In another embodiment, the mount surface 77 is positioned radially inward of the receiver surface 91 such that the pilot anchor 29 may be press fit around the pilot receiver 34. The bevel surface 76 of the pilot anchor 29 may engage the guide surface 95 of the pilot receiver 34 to guide the windage shield 117 into alignment with the fan disk 113 during installation.

Each component anchor 10 includes a fastener 12, a washer 14, a bushing 16, and a fastener retainer 18 as shown in FIG. 5. The component anchor 10 is installed along an installation axis 150 through the windage shield 117 and the fan disk 113. The fastener 12 includes a head 52 and a shaft 54 coupled to the head 52. The shaft 54 includes a substantially smooth neck section 58 and an engagement section 56 arranged to couple the fastener 12 to the fastener retainer 18. In the illustrative embodiment, the engagement section 56 and fastener retainer 18 are threaded. However, it should be noted that other arrangements for coupling the fastener 12 with the fastener retainer 18 are contemplated, such as a key, pin, spring clip, or other suitable alternative.

The washer 14 includes an annular body 62 and a fastener-receiving aperture 64 formed through the annular body 62. The annular body 62 includes an engagement surface 66 and a retainer surface 68. The engagement surface 66 is arranged to contact the bushing 16 and the pilot mount 27 of the windage shield 117. The retainer surface 68 is arranged to contact the head 52 of the fastener 12 to force the washer 14 against the bushing 16 and pilot mount 27. The pilot mount 27 includes an anchor-receiving passageway 72 formed through the pilot mount 27. The washer 14 has a larger outer diameter than the anchor-receiving passageway 72 such that the washer 14 does not pass through the anchor-receiving passageway 72.

Figure 8:
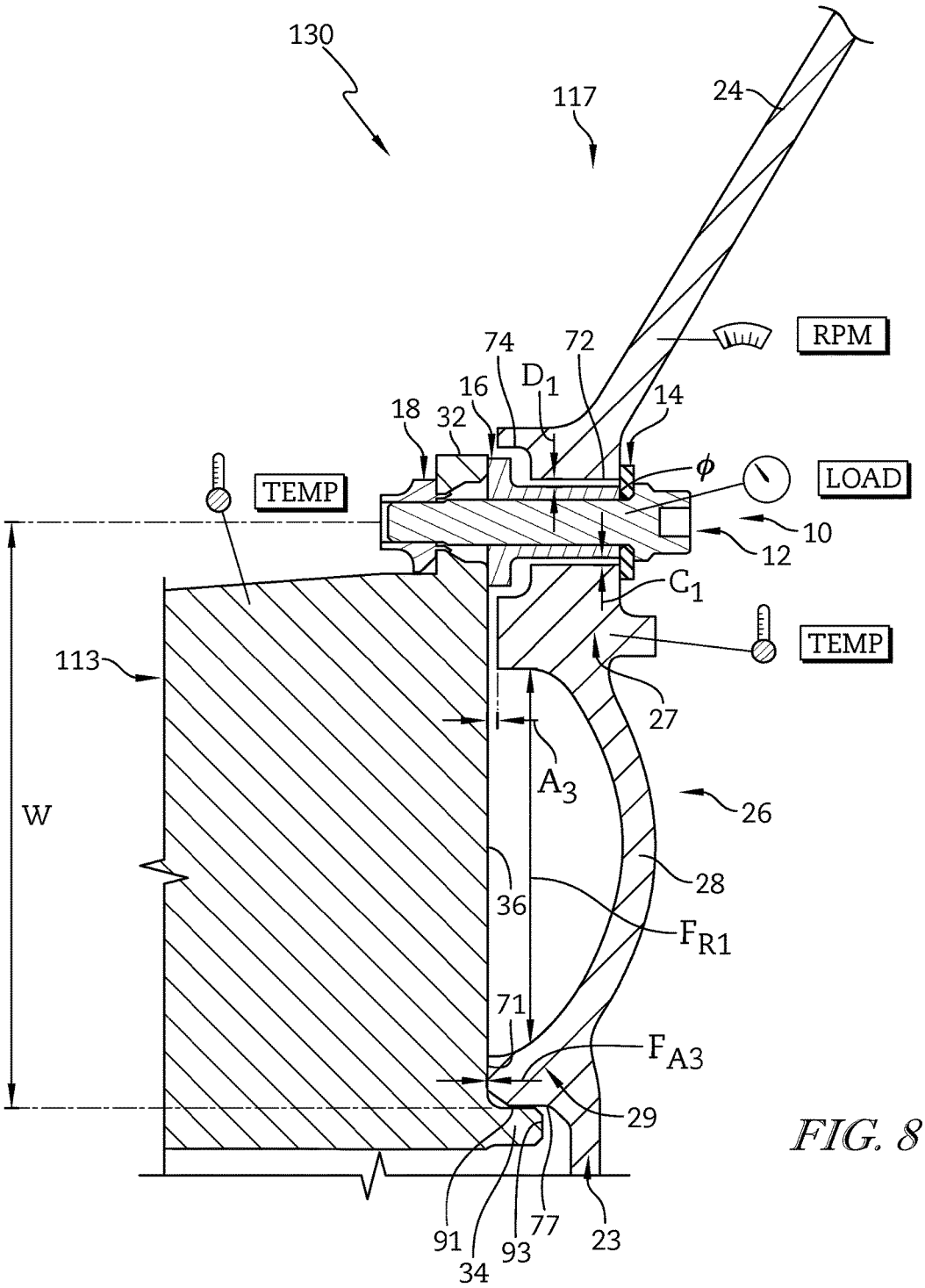
FIG. 8 is a view similar to FIG. 7 suggesting that further tightening of the fastener forces the washer to contact the bushing while the first gap ($A_3$) between windage shield and fan disk remains and elastically deforms the bias link of the pilot unit to further force the pilot anchor against the fan disk ($F_{A3}$) and against the pilot receiver ($F_{R1}$) at a distance from the component anchor (W)

The bushing 16 includes a sleeve 82 and a flange 84 coupled to one end of the sleeve 82 as shown in FIG. 5. The sleeve 82 has a smaller diameter than the anchor-receiving passageway 72 such that the sleeve 82 may pass through the anchor-receiving passageway 72 to contact the washer 14. A length of the bushing 16 is generally longer than the length of the anchor-receiving passageway 72. For example, the sleeve 82 may extend through the anchor-receiving passageway 72 to contact the washer 14 on one side of the pilot mount 27 while the flange 84 contacts the fan disk 113 on an opposing side of the pilot mount 27 as shown in FIG. 8. The pilot mount 27 further include a recess 74 formed at one end of the anchor-receiving passageway 72. The recess 74 may be sized and arranged to surround the flange 84 of the bushing 16.

The fastener retainer 18 includes an annular retainer body 92 and an inner engagement surface 94 as shown in FIG. 5. The inner engagement surface 94 is arranged to couple with the engagement section 56 of the fastener 12. The annular retainer body 92 is sized and arranged to contact the flange 32 of the fan disk 113 such that the retainer body 92 does not pass through an aperture 38 formed in the flange 32. In an alternative embodiment, the fastener 12 may be coupled directly to the flange 32 of the fan disk 113 without the use of the fastener retainer 18.

Figure 6:
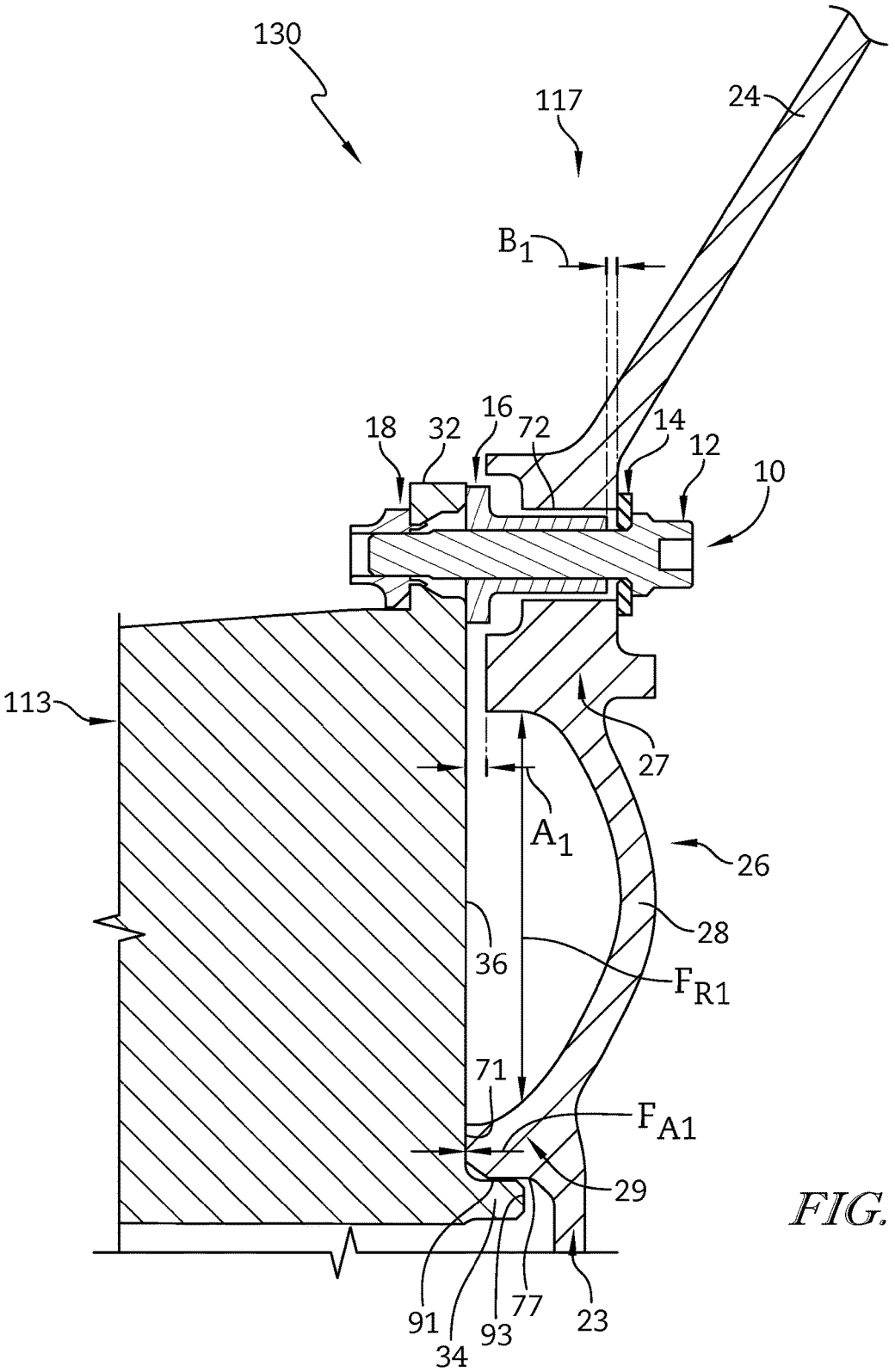
FIG. 6 is a cross-sectional view of the component anchor of FIG. 5 showing the windage shield coupled to the fan disk by the component anchor and suggesting that a first and second gap are configured between portions of the windage shield ($A_1$) and the anchor ($B_1$) as the component anchor is installed forcing the pilot unit against the fan disk ($F_{A1}$)
Figure 7:
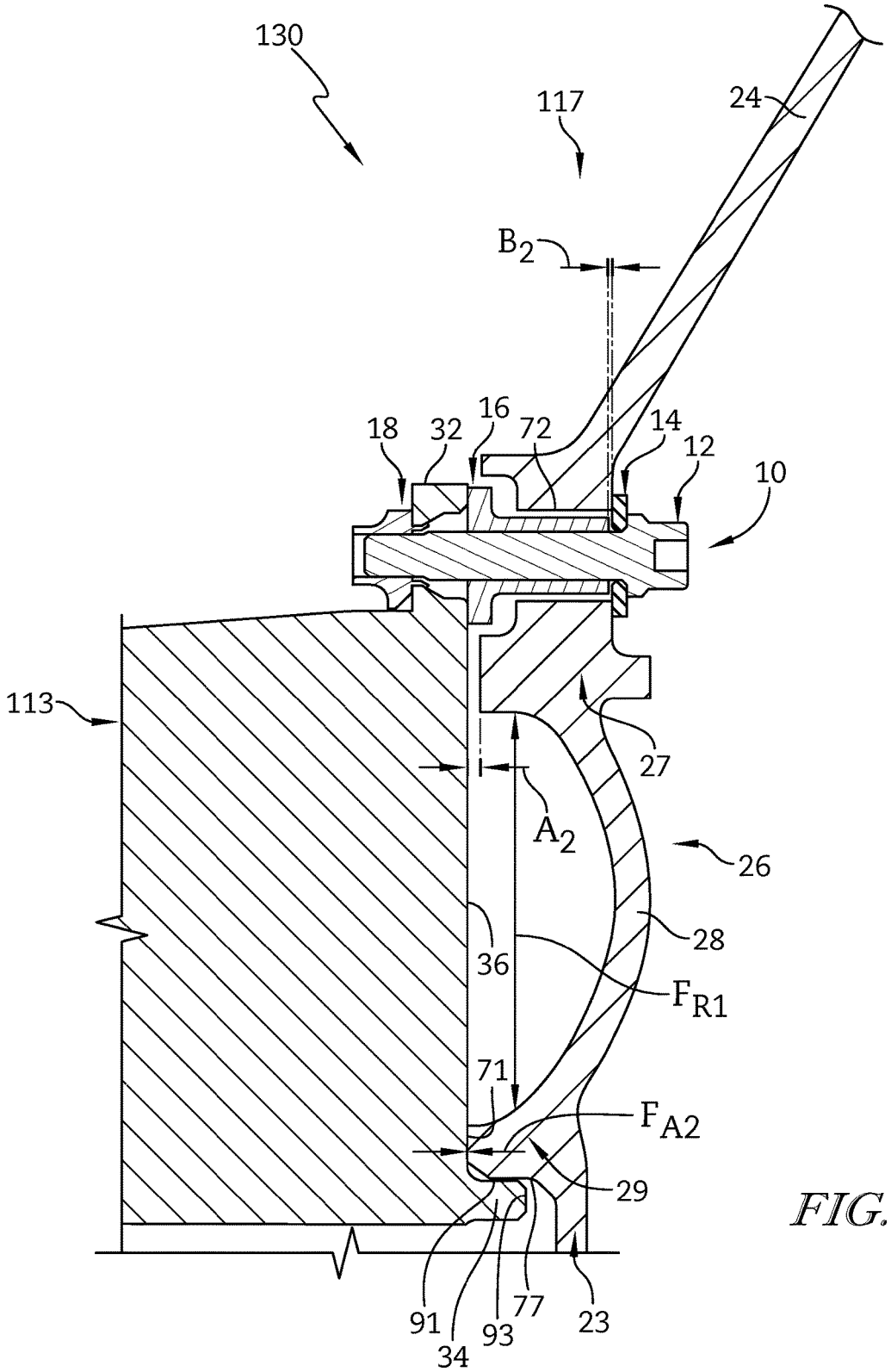
FIG. 7 is a view similar to FIG. 6 showing that tightening the fastener reduces the second gap ($B_2$) formed between the washer and bushing and the first gap ($A_2$) formed between the windage shield and the fan disk at a similar rate and further forces the pilot anchor against the fan disk ($F_{A2}$)

The windage shield 117 is coupled to the fan disk 113 by assembling the component anchor 10 as suggested in FIGS. 6-8. The windage shield 117 is aligned with the fan disk 113 such that the aperture 38 of the fan disk 113 and the anchor-receiving passageway 72 of the windage shield 117 are aligned along the installation axis 150. The fastener 12 passes along the installation axis 150 through the washer 14, the anchor-receiving passageway 72 of the windage shield 117, the bushing 16, and flange 32 of the fan disk 113 to engage the fastener retainer 18.

The fastener 12 engages the fastener retainer 18 to force the washer 14 against the pilot mount 27 of the windage shield 117 as suggested in FIG. 6. In the illustrative embodiment, the component anchor 10 positions the windage shield 117 relative to the fan disk 113 such that the pilot mount 27 of the windage shield 117 is spaced apart from the radially extending wall 36 of the fan disk 113 at a distance $A_1$ prior to the fastener 12 being tightened. Distance $A_1$ is also called gap $A_1$. At the same time, the washer 14 is spaced apart from the bushing 16 at a corresponding distance $B_1$, also called gap $B_1$. The distances $A_1$ and $B_1$ decrease at a substantially similar rate as the fastener 12 is tightened relative to the fastener retainer 18 as suggested in FIG. 7. For example, distance $A_1$ decreases to a distance $A_2$ as the fastener 12 is tightened and the distance $B_1$ decreases by substantially the same amount to a distance $B_2$. Additional tightening of the fastener 12 forces the washer 14 to contact the bushing 16 which forces the bushing 16 against the fan disk 113 to move the windage shield 117 to a distance $A_3$ from the fan disk 113 as suggested by FIG. 8. The fastener 12 may then be further tightened to an operating tension to retain the windage shield 117 on the fan disk 112 during operation of the gas turbine engine 100.

The bias link 28 may elastically deform during installation of the component anchor 10 as the gap $A_1$ decreases to gap $A_3$ as suggested in FIGS. 6-8. In the illustrative embodiment, the contact surface 71 of the pilot anchor 29 engages the radially extending wall 36 of the fan disk 113 with an initial force $F_{A1}$. Tightening of the fastener 12 forces the pilot mount 27 to move relative to the pilot anchor 29 and elastically deform the bias link 28 as the pilot anchor 29 is further force against the fan disk 113 to a force $F_{A2}$. The curved profile of the bias link 28 causes the bias link 28 to act as a spring form and deformation of the bias link 28 forces the mount surface 77 of the pilot anchor 29 against the receiver surface 91 of the pilot receiver 34 with a force $F_{R1}$ as suggested in FIG. 8. Upon completed installation, the pilot anchor 29 may be forced against the fan disk 113 to a force $F_{A3}$ which is relatively higher than force $F_{A2}$. The inner tab 23 may be spaced apart from the end surface 93 of the pilot receiver 34 when contact surface 71 of the pilot anchor 29 contacts the wall 36 of the fan disk 113.

Figure 9:
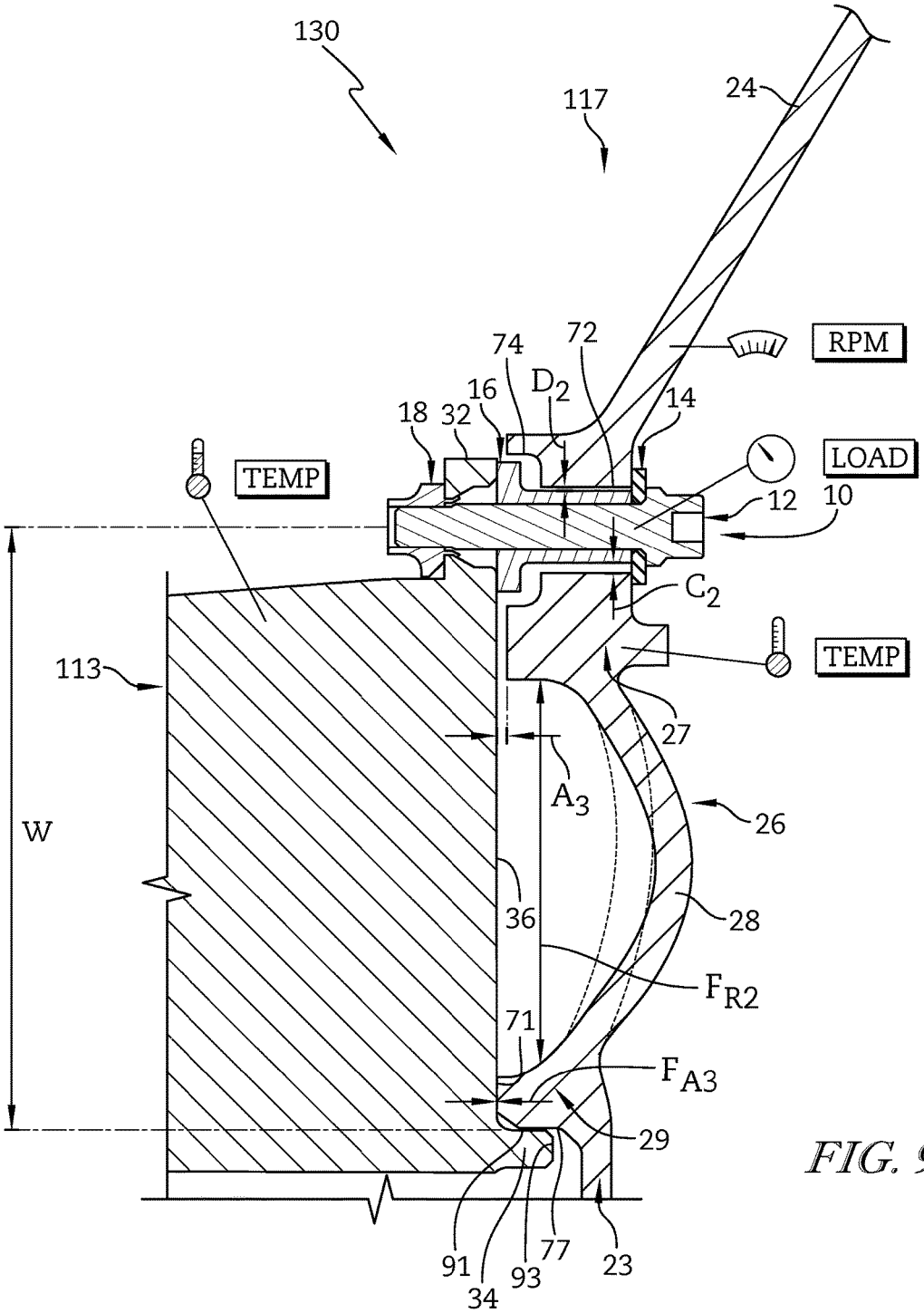
FIG. 9 is a view similar to FIG. 8 suggesting that the bias link contracts radially with the windage shield as the temperature and rotational speed of the fan disk increase to reduce and outer gap ($D_1$-$D_2$) and increase an inner gap ($C_1$-$C_2$) formed between the bushing and an anchor-receiving space formed in the windage shield due to a differential in thermal and mechanical expansion rates between the windage shield and the fan disk while the radial load on the fastener remains low and that the force between the pilot anchor and pilot receiver is increased ($F_2$) while the pilot anchor is maintained at substantially the same distance from the component anchor (W)
Figure 10:
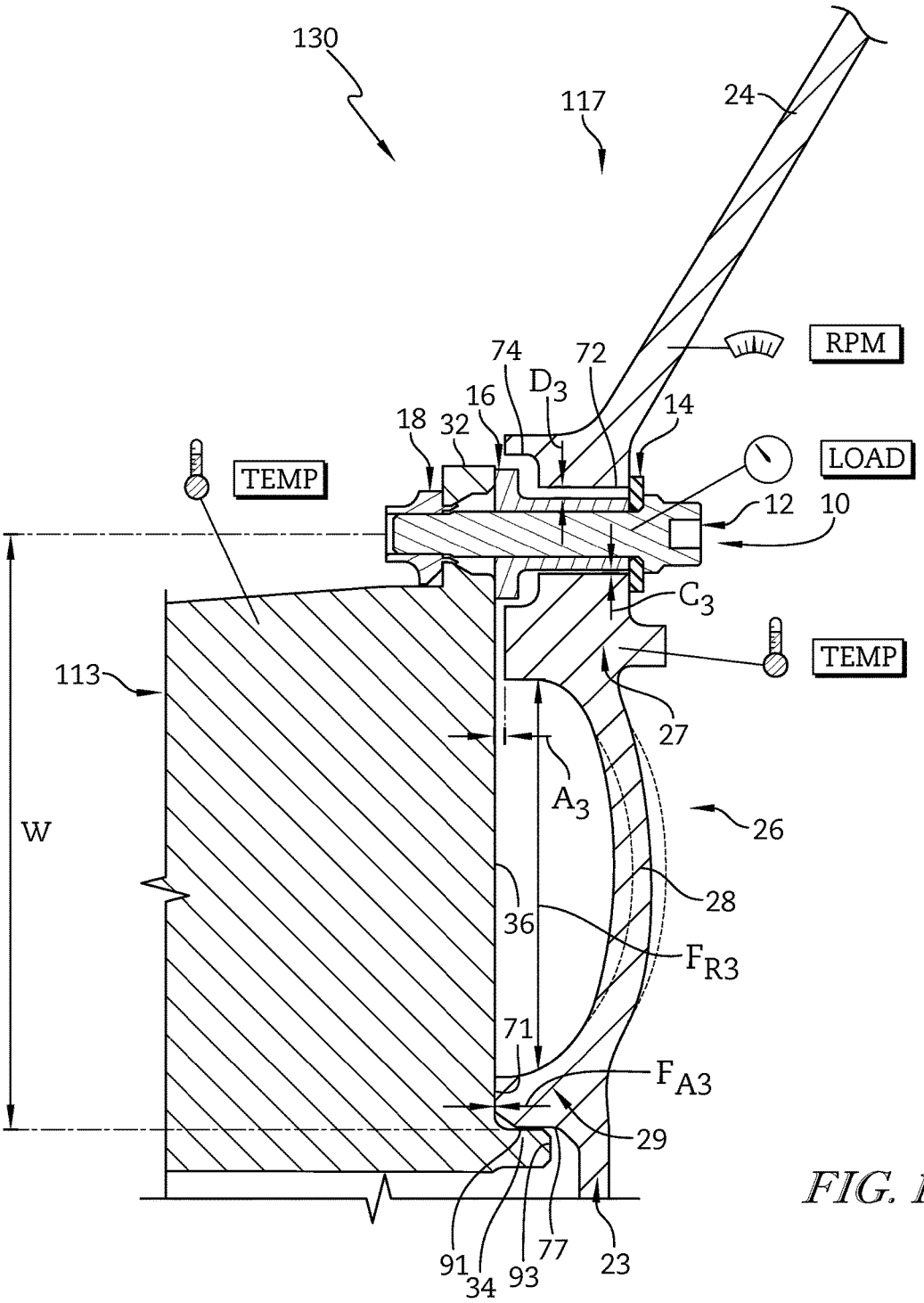
FIG. 10 is a view similar to FIG. 9 suggesting that the bias link expands radially with the windage shield as the temperature and rotational speed of the fan disk decrease to reduce the inner gap ($C_2$-$C_3$) and increase the outer gap ($D_2$-$D_3$) while a radial load on the fastener remains low and that the force between the pilot anchor and pilot receiver is reduced ($F_3$) while the pilot anchor is maintained at substantially the same distance from the component anchor (W)

The bias link 28 maintains the pilot anchor 29 at a substantially constant distance W from the component anchor 10 during operation of the gas turbine engine 100 as suggested in FIGS. 8-10. The component anchor 10 is sized to allow for radial expansion and contraction of the windage shield 117. A radially inner gap $C_1$ and a radially outer gap $D_1$ are formed between the sleeve 82 and the anchor-receiving passageway 72 when the component anchor 10 is assembled and the windage shield 117 is coupled to the fan disk 113 as shown in FIG. 8. In the illustrative embodiment, the gaps $C_1$ and $D_1$ are substantially the same size when the temperature and rotational speed of the windage shield 117 are low, for example, prior to operation of the engine 100.

The fan disk 113 may radially expand during operation of the gas turbine engine 100 increasing the size of gap $C_1$ to a gap $C_2$ and decreasing the size of gap $D_1$ to a gap $D_2$ as suggested in FIG. 9. The fan disk 113 may expand due to increased rotational speed and/or temperature. A relative expansion between the fan disk 113 and windage shield 117 may occur. For example, the fan disk 113 may be made of titanium while the windage shield 117 is made of aluminum. The difference in the coefficients of thermal expansion and modulus of elasticity between the materials may cause the fan disk 113 to expand further or more rapidly than the windage shield 117. For example, the weight of the fan blades 115 attached to the fan disk 113 places a greater load on the fan disk 113 than the shield wall 22 and support wall 24 place on the pilot unit 26 of the windage shield 117 forcing the fan disk 113 to expand faster than the windage shield 117.

As such, the bias link 28 may also radially contract as suggested in FIG. 9. Radial contraction of the bias link 28 increases the force applied by the bias link 28 to the pilot anchor 29 to a force $F_{R2}$. The force $F_{R2}$ maintains the pilot anchor 29 at the distance W from the component anchor 10 such that the mount surface 77 remains in contact with the receiver surface 91 and maintains alignment of the windage shield 117 relative to the fan disk 113. Additionally, the force $F_{R2}$ creates a frictional force between the mount surface 77 and receiver surface 91. The friction force maintains tangential alignment of the windage shield 117 with the fan disk 113.

The fan disk 113 may radially contract during run down of the gas turbine engine 100 decreasing the size of gap $C_2$ to a gap $C_3$ and increasing the size of gap $D_2$ to a gap $D_3$ as suggested in FIG. 10. The fan disk 113 may contract due to reduced rotational speed and temperature. A relative contraction between the fan disk 113 and windage shield 117 may occur. For example, the fan disk 113 may be made of titanium while the windage shield 117 is made of aluminum. The difference in the coefficients of thermal expansion and modulus of elasticity between the materials may cause the fan disk 113 to contract further or more rapidly than the windage shield 117. For example, the windage shield 117 may remain in a hot and expanded state longer than the fan disk 113.

The bias link 28 may also radially expand as suggested in FIG. 10. Radial expansion of the bias link 28 decreases the force applied by the bias link 28 to the pilot anchor 29 to a force $F_3$. However, the force $F_{R3}$ is large enough to maintain the pilot anchor 29 at the distance W from the component anchor 10 such that the mount surface 77 remains in contact with the receiver surface 91 and maintains alignment of the windage shield 117 relative to the fan disk 113. Additionally, the force $F_{R3}$ creates a frictional force between the mount surface 77 and receiver surface 91. The friction force maintains tangential alignment of the windage shield 117 with the fan disk 113.

Figure 11:
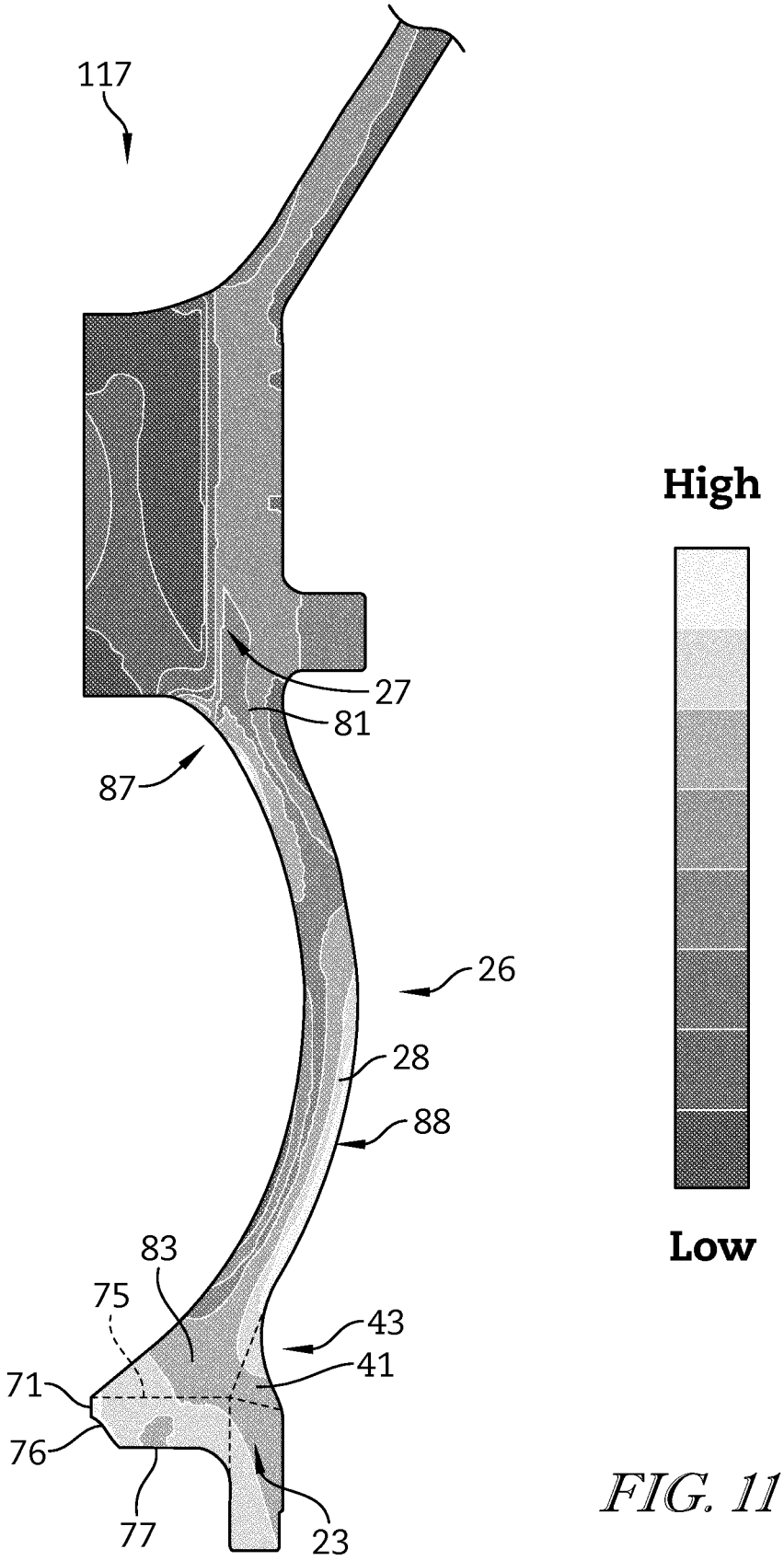
FIG. 11 is a cross-sectional view of the pilot unit of the windage shield of FIG. 8 showing the stresses within the pilot unit and suggesting that high stresses are placed on the bias link rather than on the rest of the windage shield.
Figure 12:
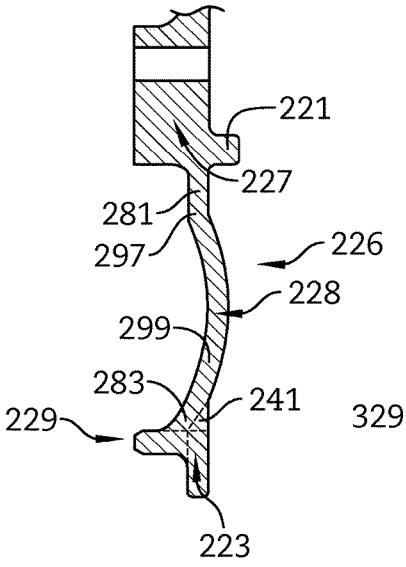
FIG. 12 is a cross-sectional view of anther embodiment of a pilot unit of the windage shield in accordance with the present disclosure.

The pilot unit 26 relieves the stresses of maintaining alignment of the windage shield 117 with the fan disk 113 by placing them in the bias link 28 and pilot anchor 29 as suggested in FIG. 11. A fillet 87 may be formed between the first end 81 of the bias link 28 and the pilot mount 27. As suggested in FIG. 11, the fillet 87 may carry a high stress as compared to the pilot mount 27. For example, the first end 81 of the bias link 28 and fillet 87 may allow the bias link 28 to bend relative to the pilot mount 27 to relieve stress therefrom.

Similarly, a backside 88 of the bias link 28 may carry a high stress flowing down into the pilot support 41 as suggested in FIG. 11. The high stress of the backside 88 may be due to the elastic deformation of the bias link 28 during expansion and contraction of the windage shield 117 during operation of the gas turbine engine 100. The pilot support 41 and channel 43 may allow the pilot anchor 29 to bend relative to the bias link 28 relieving stress from the pilot anchor 29. The pilot anchor 29 carries a high stress due to being forced against the pilot receiver 34 to align the windage shield 117 with the fan disk 113. However, this is a benefit as the stress placed on the pilot anchor 29 is not transmitted to the pilot mount 27 and other parts of the windage shield 117.

A variety of pilot unit configurations may be used to obtain the benefits described herein as suggested in FIGS. 12-17. In one embodiment of a pilot unit 226, a bias link 228 may include a substantially straight section 297 coupled to a pilot mount 227 and a curved section 299 coupled to the substantially straight section 297 as suggested in FIG. 12. A second end 283 of the bias link 228 may be coupled to the pilot anchor 229 and an inner tab 223 may be coupled to the pilot anchor 229 with a pilot support 241 coupled between the second end 283 of the bias link 228 and the inner tab 223. In the illustrative embodiment, no channel is formed between the bias link 228 and inner tab 223. The pilot unit 226 may further include an outer tab 221 coupled to the pilot mount 227.

Figure 13:
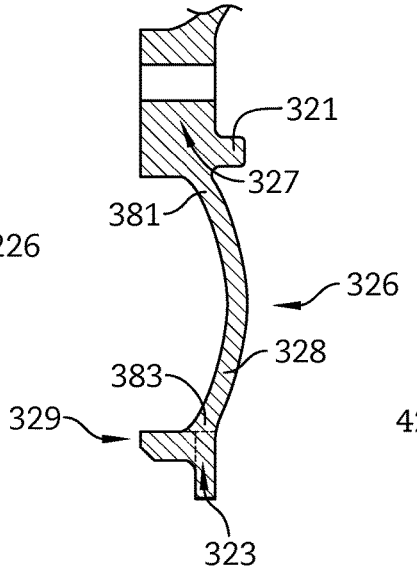
FIG. 13 is a cross-sectional view of anther embodiment of a pilot unit of the windage shield in accordance with the present disclosure.

In another embodiment of a pilot unit 326, a bias link 328 may be curved and have a first end 381 coupled to a pilot mount 327 and a second end 383 coupled to a pilot anchor 329 as suggested in FIG. 13. An inner tab 323 may be coupled to the pilot anchor 329 and the second end 383 of the bias link 328 may be coupled to both the pilot anchor 329 and inner tab 323. In the illustrative embodiment, no pilot support is used and no channel is formed between the bias link 328 and inner tab 323. The pilot unit 326 may further include an outer tab 321 coupled to the pilot mount 327.

Figure 14:
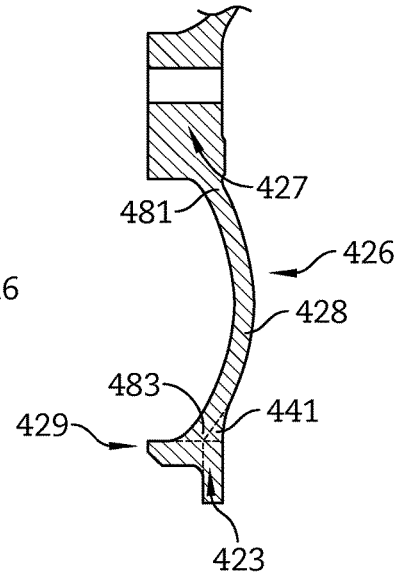
FIG. 14 is a cross-sectional view of anther embodiment of a pilot unit of the windage shield in accordance with the present disclosure.

In another embodiment of a pilot unit 426, a bias link 428 may be curved and have a first end 481 coupled to a pilot mount 427 and a second end 483 coupled to a pilot anchor 429 as suggested in FIG. 14. An inner tab 423 may be coupled to the pilot anchor 429 with a pilot support 441 coupled between the second end 483 of the bias link 428 and the inner tab 423. In the illustrative embodiment, no channel is formed between the bias link 428 and inner tab 423 and no outer tab is included.

Figure 15:
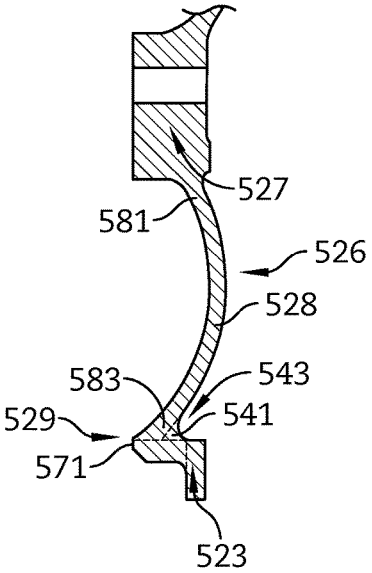
FIG. 15 is a cross-sectional view of anther embodiment of a pilot unit of the windage shield in accordance with the present disclosure.
Figure 16:
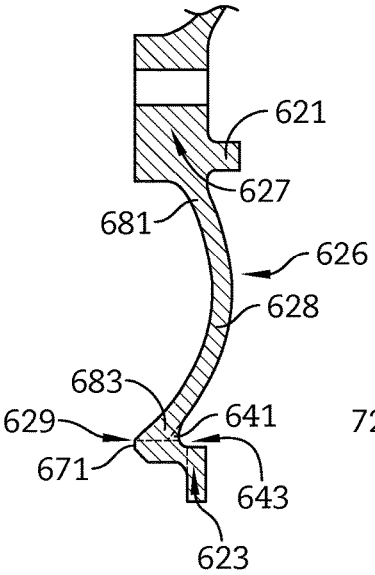
FIG. 16 is a cross-sectional view of anther embodiment of a pilot unit of the windage shield in accordance with the present disclosure.

In another embodiment of a pilot unit 526, a bias link 528 may be curved and have a first end 581 coupled to a pilot mount 527 and a second end 583 coupled to a pilot anchor 529 adjacent a contact surface 571 as suggested in FIG. 15. An inner tab 523 may be coupled to the pilot anchor 529 and a pilot support 541 may be coupled between the second end 583 of the bias link 528 and the pilot anchor 529. In the illustrative embodiment, a channel 543 is formed between the bias link 528 and inner tab 523 and no outer tab is included. A pilot unit 626 is substantially similar to the pilot unit 526 except that the pilot unit 626 includes an outer tab 621 as suggested in FIG. 16.

Figure 17:
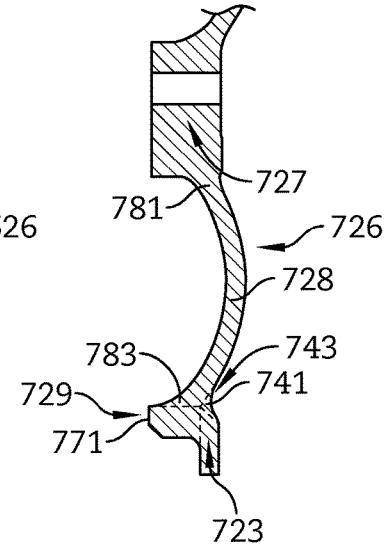
FIG. 17 is a cross-sectional view of anther embodiment of a pilot unit of the windage shield in accordance with the present disclosure.

In another embodiment of a pilot unit 726, a bias link 728 may be curved and have a first end 781 coupled to a pilot mount 727 and a second end 783 coupled to a pilot anchor 729 adjacent a contact surface 771 as suggested in FIG. 17. An inner tab 723 may be coupled to the pilot anchor 729 with a pilot support 741 coupled between the second end 783 of the bias link 728 and the inner tab 723. In the illustrative embodiment, a channel 743 is formed between the bias link 428 and inner tab 423 and no outer tab is included.

Figure 18:
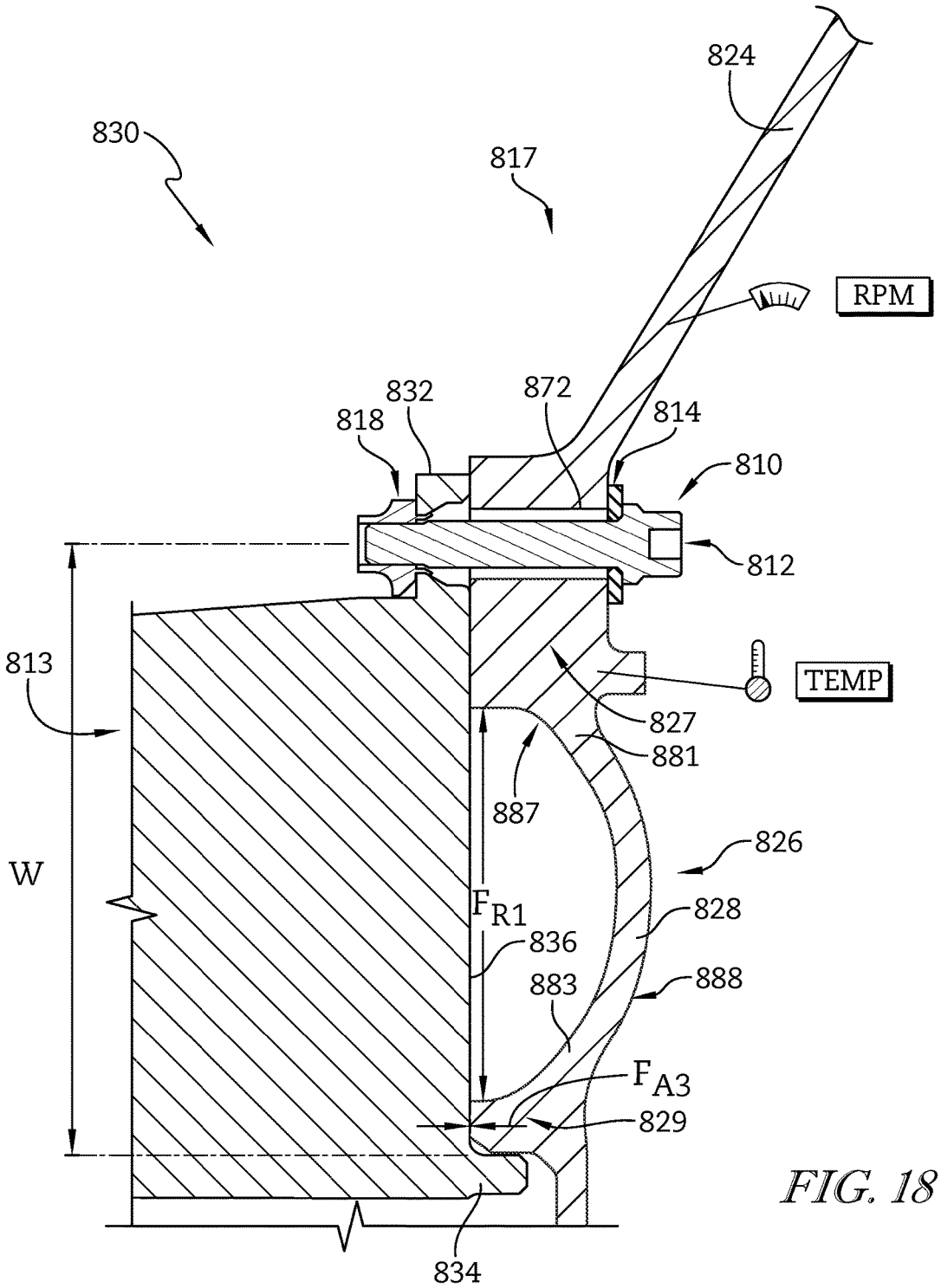
FIG. 18 is a cross-sectional view of the assembly of FIG. 4 showing an alternative attachment arrangement for coupling the windage shield to the fan disk and suggesting that there is no gap between windage shield and fan disk.

An alternative arrangement for coupling a windage shield 817 to a fan disk 813 in a fan assembly 830 is shown in FIG. 18. In the illustrative embodiment, a component anchor 810 includes a fastener 812, a washer 814, and a fastener retainer 818. The component anchor 810 is installed through an anchor-receiving passageway 872 of the windage shield 817 and a flange 832 of the fan disk 813 such that the fastener 812 engages the fastener retainer 818 to force the washer 814 against a pilot mount 827 of the windage shield 817.

In the illustrative embodiment, the component anchor 810 positions the windage shield 817 relative to the fan disk 813 such that the pilot mount 827 of the windage shield 817 contacts a radially extending wall 836 of the fan disk 813 as suggested in FIG. 18. A pilot unit 826 of the windage shield 817 includes the pilot mount 827 coupled to a support wall 824 of the windage shield 817, a bias link 828 coupled to the pilot mount 827 and extending radially inward from the pilot mount 827, and a pilot anchor 829 coupled to the bias link 828. The bias link 828 may elastically deform during installation of the component anchor 810 to force the pilot anchor 829 against a pilot receiver 834 of the fan disk 813 with a force $F_{R1}$ and against the radially extending wall 836 of the fan disk 113 with a force $F_{A3}$. The bias link 828 maintains the pilot anchor 829 at a substantially constant distance W from the component anchor 810 during operation of the gas turbine engine 100.

Figure 21:
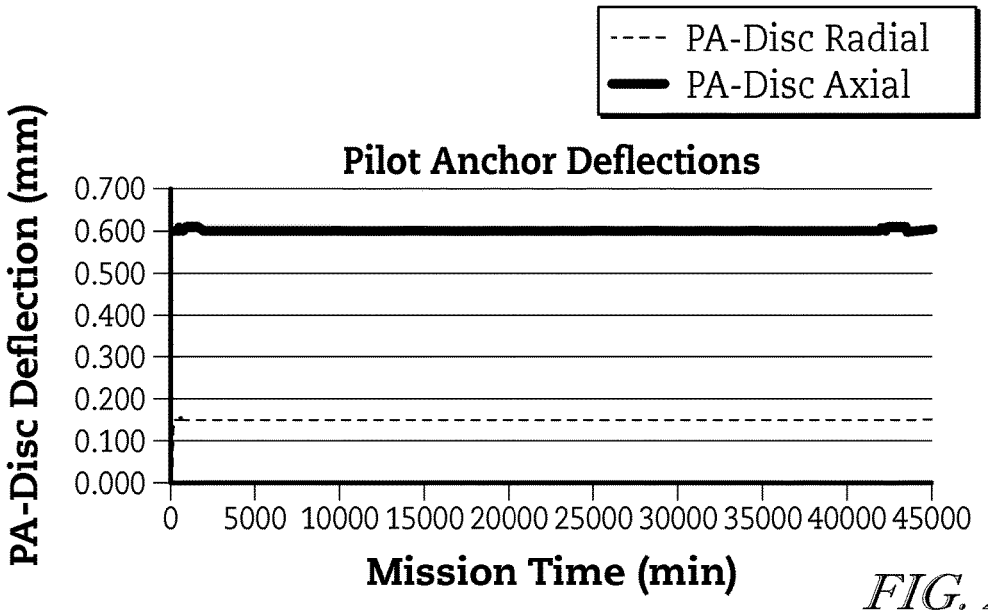
FIG. 21 is a chart showing axial deflections of the pilot anchor relative to the fan disk and the radial deflections of the pilot anchor relative to the pilot receiver and suggesting that the pilot anchor remains in a substantially constant position relative to the fan disk and pilot receiver during operation of the gas turbine engine.

The bias link 828 includes a first end 881 coupled to the pilot mount 827 and a second end 883 coupled to the pilot anchor 829 as suggested in FIG. 18. The bias link 828 assumes a generally curved shape with the curve extending away from the fan disk 813. However, any other suitable shape may be used. The bias link 828 may cooperate with the pilot anchor 829 to maintain the pilot anchor 829 in contact with a radially extending wall 836 and pilot receiver 834 of the fan disk 813 as suggested in FIG. 21. The anchor 810 couples the windage shield 817 to the fan disk 813 and the bias link 828 maintains a constant deflection of the pilot anchor 829 relative to the fan disk 813 during operation of the gas turbine engine 100. This applies similarly to the pilot units 26-726 and component anchor 10 described above.

Figure 19:
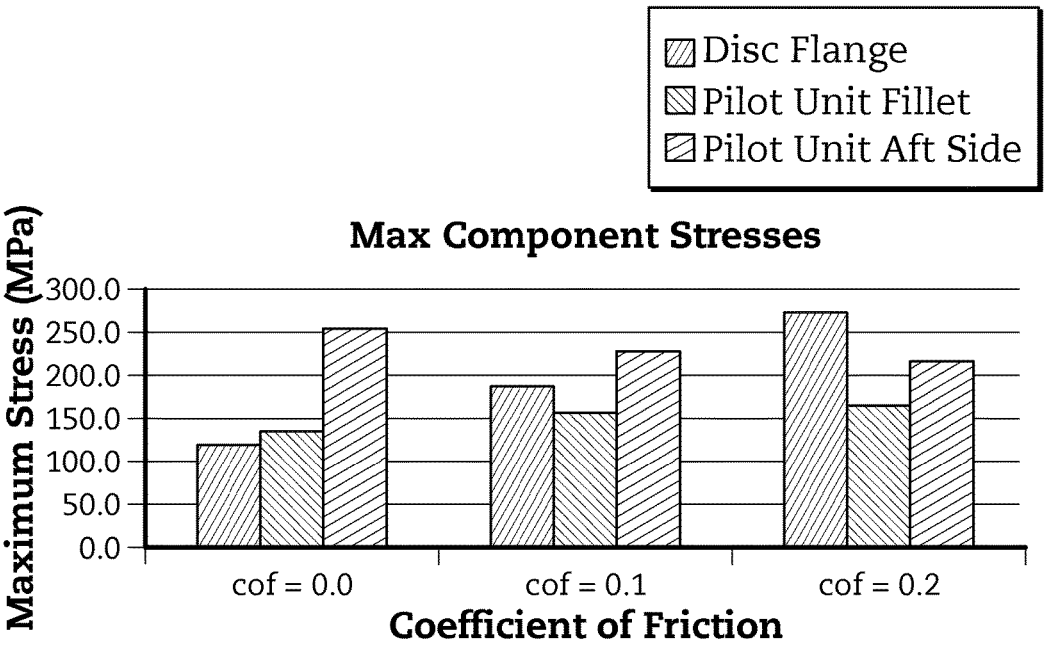
FIG. 19 is a chart showing stresses placed on a flange of the fan disk compared to stresses placed on a fillet of a reference pilot unit in accordance with the present disclosure and an aft side of the reference pilot unit when various coefficients of friction are assumed.
Figure 20:
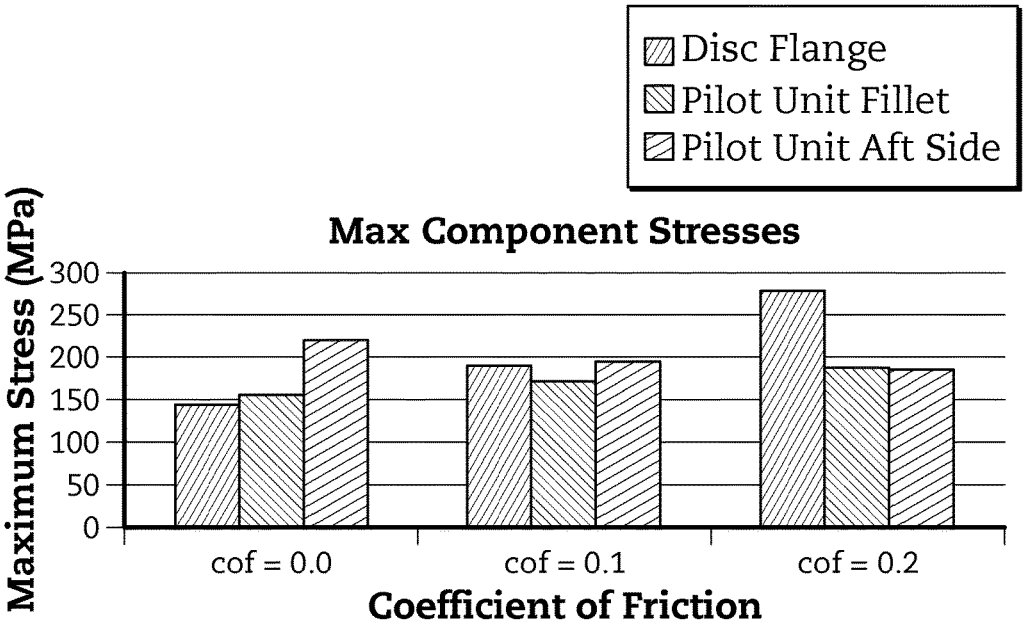
FIG. 20 is a chart showing stresses placed on a flange of the fan disk compared to stresses placed on a fillet of the pilot unit of FIG. 18 and an aft side of the pilot unit when various coefficients of friction are assumed.

Contact between the pilot mount 827 and fan disk 813 may affect stress distribution between the components due to the sliding interface between the pilot mount 827 and wall 836 as suggested in FIG. 20. A low coefficient of friction allows a fillet 887 and backside 888 of the pilot unit 826 to carry more stress than the flange 832 of the fan disk 813. The stress transfers from the fillet 887 and backside 888 to the flange 832 as the coefficient of friction increases. Additional stress is also added to the fillet 887 and backside 888 as the coefficient of friction increases. However, these stresses are relatively lower than stresses formed in a reference pilot unit which does not incorporate the features of the pilot units 26-826 as suggested in FIG. 19.

Second Aspect Of The Disclosure

In one illustrative embodiment, the one or more component anchors 10 include a fastener 12, a washer 14, a bushing 16, and a fastener retainer 18 as shown in FIG. 5. The component anchor 10 is installed along an installation axis 150 through the windage shield 117 and the fan disk 113. The fastener 12 includes a head 52 and a shaft 54 coupled to the head 52. The shaft 54 includes a substantially smooth neck section 58 and an engagement section 56 arranged to couple the fastener 12 to the fastener retainer 18. In the illustrative embodiment, the engagement section 56 and fastener retainer 18 are threaded. However, it should be noted that other arrangements for coupling the fastener 12 with the fastener retainer 18 are contemplated, such as a key, pin, spring clip, or other suitable alternative.

The washer 14 includes an annular body 62 and a fastener-receiving aperture 64 formed through the annular body 62 as shown in FIG. 5. The annular body 62 includes an engagement surface 66 and a retainer surface 68. The engagement surface 66 is arranged to contact the bushing 16 and the pilot mount 27 of the windage shield 117. The retainer surface 68 is arranged to contact the head 52 of the fastener 12 to force the washer 14 against the bushing 16 and pilot mount 27. The pilot mount 27 includes an anchor-receiving passageway 72 formed through the pilot mount 27. The washer 14 has a larger outer diameter than the anchor-receiving passageway 72 such that the washer 14 does not pass through the anchor-receiving passageway 72.

The bushing 16 includes a sleeve 82 and a flange 84 coupled to one end of the sleeve 82 as shown in FIG. 5. The sleeve 82 has a smaller diameter than the anchor-receiving passageway 72 such that the sleeve 82 may pass through the anchor-receiving passageway 72 to contact the washer 14. A length of the bushing 16 is generally longer than the length of the anchor-receiving passageway 72. For example, the sleeve 82 may extend through the anchor-receiving passageway 72 to contact the washer 14 on one side of the pilot mount 27 while the flange 84 contacts the fan disk 113 on an opposing side of the pilot mount 27 as shown in FIG. 8. The pilot mount 27 further include a recess 74 formed at one end of the anchor-receiving passageway 72. The recess 74 may be sized and arranged to surround the flange 84 of the bushing 16.

The fastener retainer 18 includes an annular retainer body 92 and an inner engagement surface 94 as shown in FIG. 5. The inner engagement surface 94 may be arranged to couple with the engagement section 56 of the fastener 12. The annular retainer body 92 is sized and arranged to contact the flange 32 of the fan disk 113 such that the retainer body 92 does not pass through an aperture 38 formed in the flange 32. In an alternative embodiment, the fastener 12 may be coupled directly to the flange 32 of the fan disk 113 without the use of the fastener retainer 18.

The windage shield 117 may be coupled to the fan disk 113 by assembling the component anchor 10 as suggested in FIGS. 5-8. The windage shield 117 is aligned with the fan disk 113 such that the aperture 38 of the fan disk 113 and the anchor-receiving passageway 72 of the windage shield 117 are aligned along the installation axis 150. The fastener 12 passes along the installation axis 150 through the washer 14, the anchor-receiving passageway 72 of the windage shield 117, the bushing 16, and flange 32 of the fan disk 113 to engage the fastener retainer 18.

The fastener 12, washer 14, and bushing 16 may be installed relative to the windage shield 117 in several different orders without departing from the benefits described herein. For example, the bushing 16 may be aligned with the anchor-receiving passageway 72 prior to the fastener 12 passing through the anchor-receiving passageway 72. In another example, the fastener 12, washer 14, and bushing 16 may be aligned relative to the anchor-receiving passageway 72 prior to the windage shield 117 being aligned with the fan disk 113.

The fastener 12 engages the fastener retainer 18 to force the washer 14 against the pilot mount 27 of the windage shield 117 as suggested in FIG. 6. In the illustrative embodiment, the component anchor 10 positions the windage shield 117 relative to the fan disk 113 such that the pilot mount 27 of the windage shield 117 is spaced apart from the radially extending wall 36 of the fan disk 113 at a distance $A_1$ prior to the fastener 12 being tightened. Distance $A_1$ is also called gap $A_1$. At the same time, the washer 14 is spaced apart from the bushing 16 at a corresponding distance $B_1$, also called gap $B_1$. The distances $A_1$ and $B_1$ decrease at a substantially similar rate as the fastener 12 is tightened relative to the fastener retainer 18 as suggested in FIG. 7. For example, distance $A_1$ decreases to a distance $A_2$ as the fastener 12 is tightened and the distance $B_1$ decreases by substantially the same amount to a distance $B_2$. Additional tightening of the fastener 12 forces the washer 14 to contact the bushing 16 which forces the bushing 16 against the fan disk 113 to move the windage shield 117 to a distance $A_3$ from the fan disk 113 as suggested by FIG. 8. The fastener 12 may then be further tightened to an operating tension to retain the windage shield 117 on the fan disk 112 during operation of the gas turbine engine 100. In one embodiment, the washer 14 and bushing 16 are formed as a monolithic component where the bushing 16 is spaced at distances $B_1$, $B_2$ from the fan disk 113 during installation of the component anchor.

Figure 22:
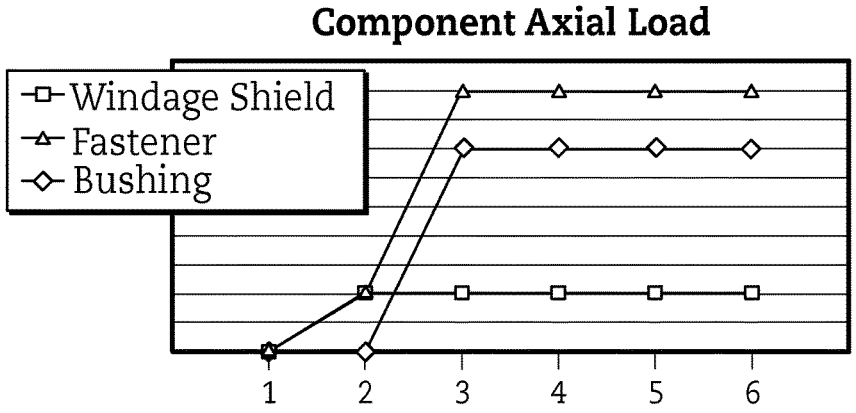
FIG. 22 is a chart showing the axial loads on the windage shield, fastener, and bushing during assembly and operation of the gas turbine and suggesting that tightening the fastener places a low axial load on the windage shield which remains substantially constant during operation of the gas turbine engine.

The component anchor 10 couples the windage shield 117 to the fan disk 113 while maintaining a substantially constant axial load on the windage shield 117 as suggested in FIG. 22. Position 1 of the chart in FIG. 22 generally corresponds to the arrangement shown in FIG. 6. In this arrangement, the component anchor 10, anchor-receiving passageway 72, and aperture 38 are aligned along the installation axis 150 and the component anchor 10 has not placed an axial load on the windage shield 117 relative to the fan disk 113.

Position 2 of the chart in FIG. 22 generally corresponds to the arrangement shown in FIG. 7. In this arrangement, the fastener 12 has been tightened to place an axial load on the fastener 12 and a corresponding axial load on the windage shield 117 to maintain alignment of the windage shield 117 with the fan disk 113.

Position 3 of the chart in FIG. 22 generally corresponds to the arrangement shown in FIG. 8. In this arrangement, the washer 14 has contacted the bushing 16 and the fastener 12 has been tightened to the operating tension to retain the windage shield 117 on the fan disk 112 during operation of the gas turbine engine 100. The added tension of the fastener 12 is placed on the bushing 16 instead of the windage shield 117 due to the distance $A_3$ between the windage shield 117 and fan disk 113. As such, the axial load placed on the windage shield 117 is relatively low compared to the loads placed on the fastener 12 and bushing 16. The combined axial load placed on the bushing 16 and windage shield 117 is substantially equal to the tension in the fastener 12 as suggested in FIG. 22.

The component anchor 10 is sized to allow for radial expansion and contraction of the windage shield 117 during operation of the gas turbine engine 100 as suggested in FIGS. 8-10. A radially inner gap $C_1$ and a radially outer gap $D_1$ are formed between the sleeve 82 and the anchor-receiving passageway 72 when the component anchor 10 is assembled and the windage shield 117 is coupled to the fan disk 113 as shown in FIG. 8.

In the illustrative embodiment, the gaps $C_1$ and $D_1$ are substantially the same size when the temperature and rotational speed of the windage shield 117 are low, for example, prior to operation of the engine 100. The gaps $C_1$ and $D_1$ allow for the windage shield 117 to be coupled to the fan disk 113 without placing additional radial load on the fastener 12 of the component anchor 10.

The fan disk 113 may radially expand during operation of the gas turbine engine 100 increasing the size of gap $C_1$ to a gap $C_2$ and decreasing the size of gap $D_1$ to a gap $D_2$ as suggested in FIG. 9. The fan disk 113 may expand due to increased rotational speed and/or temperature. A relative expansion between the fan disk 113 and windage shield 117 may occur. For example, the fan disk 113 may be made of titanium while the windage shield 117 is made of aluminum. The difference in the coefficients of thermal expansion and modulus of elasticity between the materials may cause the fan disk 113 to expand further or more rapidly than the windage shield 117. For example, the weight of the fan blades 115 attached to the fan disk 113 places a greater load on the fan disk 113 than the shield wall 22 and support wall 24 place on the pilot unit 26 of the windage shield 117 forcing the fan disk 113 to expand faster than the windage shield 117. However, the radial load placed on the fastener 12 of the component anchor 10 remains low because the gap $D_2$ remains even during operation of the engine 100 as suggested in FIG. 9.

The fan disk 113 may radially contract during run down of the gas turbine engine 100 decreasing the size of gap $C_2$ to a gap $C_3$ and increasing the size of gap $D_2$ to a gap $D_3$ as suggested in FIG. 10. The fan disk 113 may contract due to reduced rotational speed and temperature. A relative contraction between the fan disk 113 and windage shield 117 may occur. For example, the fan disk 113 may be made of titanium while the windage shield 117 is made of aluminum. The difference in the coefficients of thermal expansion and modulus of elasticity between the materials may cause the fan disk 113 to contract further or more rapidly than the windage shield 117. For example, the windage shield 117 may remain in a hot and expanded state longer than the fan disk 113. However, the radial load placed on the fastener 12 of the component anchor 10 remains low because the gap $C_3$ remains even during run down of the engine 100.

The relative expansion and contraction of the windage shield 117 in relation to the fan disk 113 causes a corresponding movement of the windage shield 117 relative to the component anchor 10 as suggested in FIGS. 9 and 10. This relative movement may cause fretting to occur and damage the windage shield 117. However, the component anchor 10 minimizes the amount of fretting due to the limited contact between the components. For example, the component anchor 10 allows for the windage shield 117 to be spaced apart from the fan disk 113 by the distance $A_3$ during operation of the engine 100 as detailed above. This minimizes contact between the windage shield 117 and fan disk 113 and minimizes fretting. In another example, the washer 14 provides limited contact with the windage shield 117 to retain the windage shield 117 on the fan disk 113 while reducing fretting.

Figure 23:
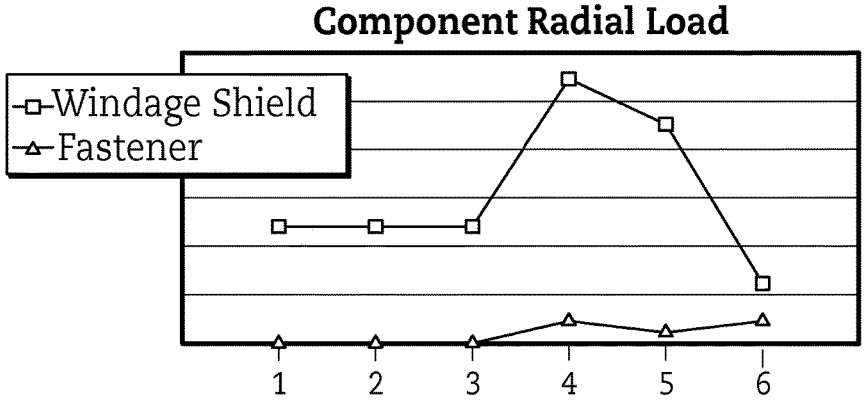
FIG. 23 is a chart similar to FIG. 21 showing the radial loads on the windage shield and fastener and suggesting that the radial load on the fastener remains low as the radial load on the windage shield changes during operation of the gas turbine engine.

The component anchor 10 minimizes radial loads placed on the fastener 12 and minimizes axial loads placed on the windage shield 117 as suggested in FIGS. 22 and 23. As described above, position 1 of the charts generally corresponds to the arrangement shown in FIG. 6. In this arrangement, the component anchor 10, anchor-receiving passageway 72, and aperture 38 are aligned along the installation axis 150 such that minimal radial load is placed on the fastener 12. The pilot anchor 29 of the windage shield 117 is arranged to be press fit with the pilot receiver 34 of the fan disk 113 placing an initial radial load on the windage shield 117 as suggested in FIG. 23. The press fit creates a frictional force between the pilot anchor 29 and pilot receiver 34 which provides tangential alignment of the windage shield 117 with the fan disk 113.

Position 2 of the charts in FIGS. 22 and 23 generally correspond to the arrangement shown in FIG. 7. In this arrangement, the fastener 12 has been tightened causing the bias link 28 of the windage shield 117 to elastically deform and further force the pilot anchor 29 against the pilot receiver 34. The axial load placed on the fastener 12 increases while the radial load placed on the fastener 12 remains low due to the gaps $C_1$ and $D_1$ as described above.

Position 3 of the charts in FIGS. 22 and 23 generally correspond to the arrangement shown in FIG. 8. In this arrangement, tightening of the fastener 12 increases the axial loads in the fastener 12 and bushing 16 while the radial loads on the fastener 12 and windage shield 117 remain substantially constant.

Positions 4-6 of the charts in FIGS. 22 and 23 generally correspond to various operating conditions of the gas turbine engine 100. Position 4 corresponds to engine conditions during take-off of an aircraft. The gas turbine engine 100 may experience increased loading during take-off placing increased radial loading on the windage shield 117 as suggested in FIG. 23. However, the radial loading on the fastener 12 of component anchor 10 remains low as suggested and described above with regard to FIG. 9. Axial loading of the windage shield 117 remains substantially constant due to the distance $A_3$ from the fan disk 113 and ability to move relative to the component anchor 10 as described above and as suggested in FIG. 22. Frictional forces between the windage shield 117 and washer 14 may vary the radial loads placed on the fastener 12 during relative expansion between the windage shield 117 and fan disk 113 as described above.

Position 5 of the charts in FIGS. 22 and 23 corresponds to engine conditions during flight. The engine 100 may generally experience decreased loading compared to the take-off conditions while the aircraft is in flight. As such, the radial loading on the windage shield 117 is also decreased as compared to take-off loading. The radial loading on the fastener 12 and axial loading on the windage shield 117 remain substantially constant during flight.

Position 6 corresponds to engine conditions during landing of the aircraft and run down of the engine 100. The gas turbine engine 100 may begin to cool during landing causing the fan disk 113 to contract and the windage shield 117 to experience decreased radial loading. However, the radial loading on the fastener 12 of component anchor 10 remains low as suggested and described above with regard to FIG. 10. The axial loading on the windage shield 117 remain substantially constant during landing.

Third Aspect Of The Disclosure

Figure 24:
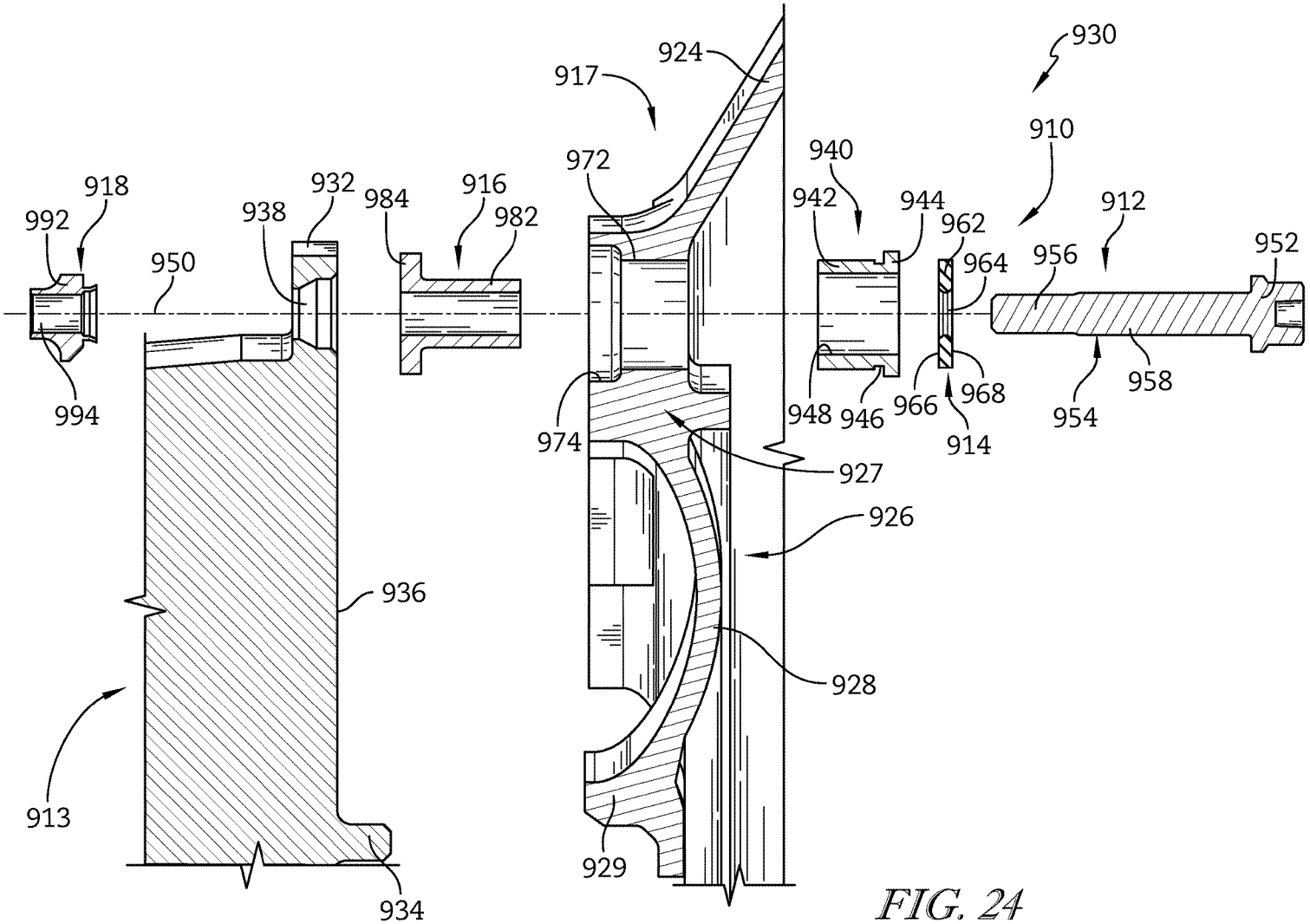
FIG. 24 is an exploded cross-sectional view of another embodiment of an anchor in accordance with the present disclosure showing that the anchor includes, from left to right, a fastener retainer, a bushing, an insert, a washer, and a fastener.

Another alternative arrangement for coupling a windage shield 917 to a fan disk 913 in a fan assembly 930 is shown in FIG. 24. In the illustrative embodiment, a component anchor 910 includes a fastener 912, washer 914, insert 940, bushing 916, and fastener retainer 918. The component anchor 910 is installed along an installation axis 950 through an anchor-receiving passageway 972 of the windage shield 917 and a flange 932 of the fan disk 913.

The fastener 912 includes a head 952 and a shaft 954 coupled to the head 952. The shaft 954 includes a substantially smooth neck section 958 and an engagement section 956 arranged to couple the fastener 912 to the fastener retainer 918. In the illustrative embodiment, the engagement section 956 and fastener retainer 918 are threaded. However, it should be noted that other arrangements for coupling the fastener 912 with the fastener retainer 918 are contemplated, such as a key, pin, spring clip, or other suitable alternative.

The insert 940 generally includes a tube 942 and a flange 944 coupled to the tube 942 as shown in FIG. 24. The tube 942 may be sized to pass into the anchor-receiving passageway 972 of the windage shield 917 and mate with an interior surface of the anchor-receiving passageway 972. The flange 944 may have a larger outer diameter than the anchor-receiving passageway 972 such that the insert 940 does not pass through the anchor-receiving passageway 972. The flange 944 is arranged to contact the pilot mount 927 to force the windage shield 917 toward the fan disk 913 as will be described further herein.

The washer 914 includes an annular body 962 and a fastener-receiving aperture 964 formed through the annular body 962 as shown in FIG. 24. The annular body 962 includes an engagement surface 966 and a retainer surface 968. The engagement surface 966 is arranged to contact the bushing 916 and the flange 944 of the insert 940. The retainer surface 968 is arranged to contact the head 952 of the fastener 912 to force the washer 914 against the bushing 916 and insert 940. The washer 914 has a larger outer diameter than a bushing-receiving passageway 948 of the tube 942 such that the washer 914 does not pass through the insert 940.

The bushing 916 includes a sleeve 982 and a flange 984 coupled to one end of the sleeve 982 as shown in FIG. 24. The sleeve 982 has a smaller diameter than the bushing-receiving passageway 948 of the insert 940 such that the sleeve 982 may pass through the insert 940 to contact the washer 914. A length of the bushing 916 is generally longer than the length of the anchor-receiving passageway 972. For example, the sleeve 982 may extend through the anchor-receiving passageway 972 to contact the washer 914 on one side of the pilot mount 927 while the flange 984 contacts the fan disk 913 on an opposing side of the pilot mount 927 as shown in FIG. 24. The pilot mount 927 further includes a recess 974 formed at one end of the anchor-receiving passageway 972. The recess 974 may be sized and arranged to surround the flange 984 of the bushing 916.

The fastener retainer 918 generally includes an annular retainer body 992 and an inner engagement surface 994 as shown in FIG. 24. As described above, the inner engagement surface 994 may be arranged to couple with the engagement section 956 of the fastener 912. The annular retainer body 992 is sized and arranged to contact the flange 932 of the fan disk 913 such that the retainer body 992 does not pass through an aperture 938 formed in the flange 932. In an alternative embodiment, the fastener 912 may be coupled directly to the flange 932 of the fan disk 913 without the use of the fastener retainer 918.

A pilot unit 926 of the windage shield 917 includes the pilot mount 927 coupled to a support wall 924 of the windage shield 917, a bias link 928 coupled to the pilot mount 927 and extending radially inward from the pilot mount 927, and a pilot anchor 929 coupled to the bias link 928 as suggested in FIG. 24. The bias link 928 may elastically deform during installation of the component anchor 910 to force the pilot anchor 929 against a pilot receiver 934 of the fan disk 913 with a force $F_{R1}$ and against the radially extending wall 936 of the fan disk 113 with a force $F_{A3}$ as suggested in FIG. 25. The bias link 928 maintains the pilot anchor 929 at a substantially constant distance W from the component anchor 910 during operation of the gas turbine engine 100.

Figure 25:
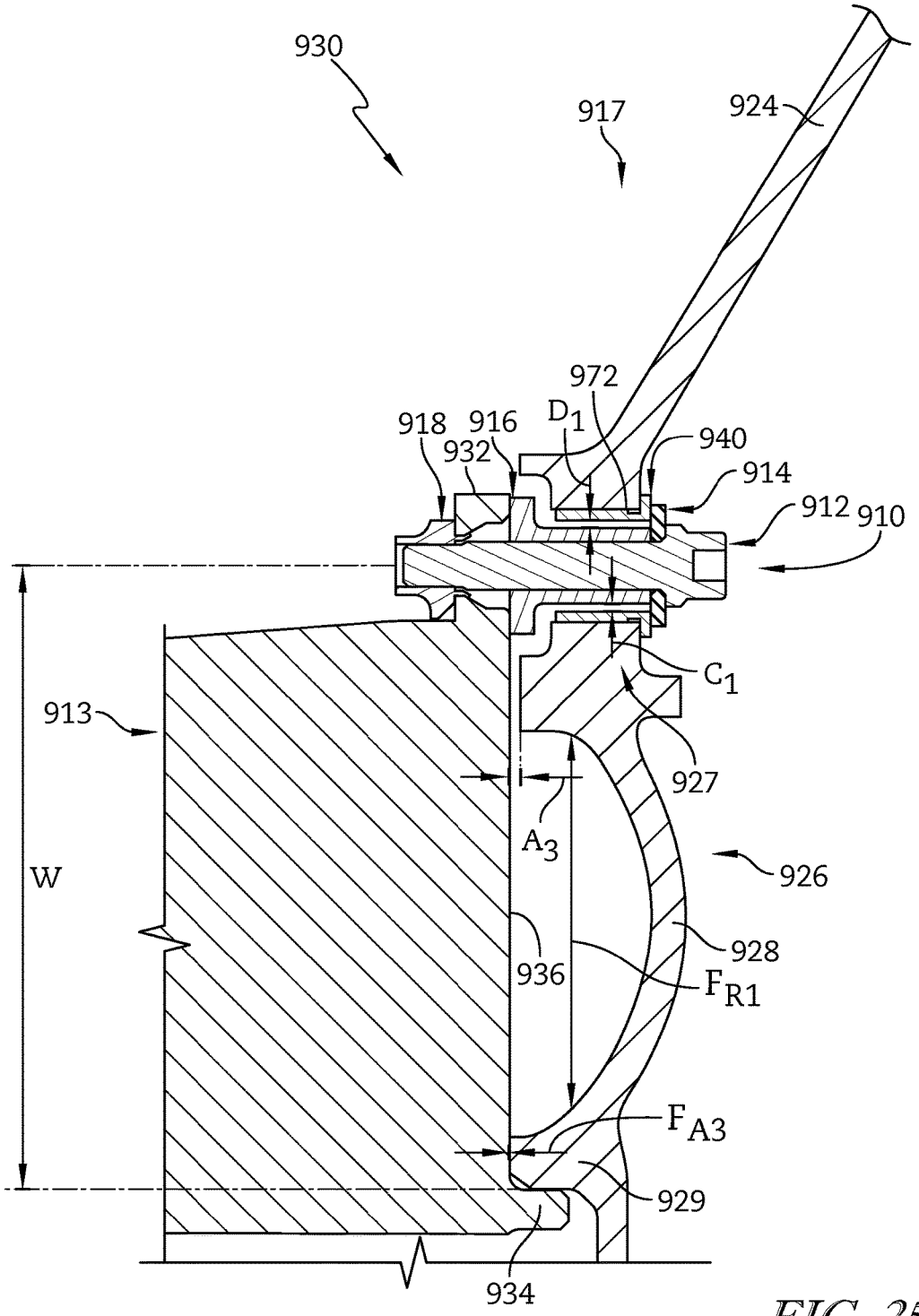
FIG. 25 is a cross-sectional view of the anchor of FIG. 24 showing the windage shield coupled to the fan disk by the anchor and suggesting that the stresses in the anchor are minimized as a result of several gaps being configured between portions of the windage shield and the anchor.

The bias link 928 assumes a generally curved shape with the curve extending away from the fan disk 913 as suggested in FIG. 25. However, any other suitable shape may be used. The bias link 928 may cooperate with the pilot anchor 929 to maintain the pilot anchor 929 in contact with a radially extending wall 936 and pilot receiver 934 of the fan disk 913. The anchor 910 couples the windage shield 917 to the fan disk 913 and the bias link 928 maintains a constant deflection of the pilot anchor 929 relative to the fan disk 913 during operation of the gas turbine engine 100.

The windage shield 917 may be coupled to the fan disk 913 by assembling the component anchor 910 as suggested in FIG. 25. The windage shield 917 is aligned with the fan disk 913 such that the aperture 938 of the fan disk 913 and the anchor-receiving passageway 972 of the windage shield 917 are aligned along the installation axis 950. The fastener 912 passes along the installation axis 950 through the washer 914, the insert 940, the anchor-receiving passageway 972 of the windage shield 917, the bushing 916, and flange 932 of the fan disk 913 to engage the fastener retainer 918.

The fastener 912, insert 940, washer 914, and bushing 916 may be installed relative to the windage shield 917 in several different orders without departing from the benefits described herein. For example, the bushing 916 may be aligned with the anchor-receiving passageway 972 prior to the fastener 912 passing through the anchor-receiving passageway 972. In another example, the bushing 916 and insert 940 may be aligned with the anchor-receiving passageway 972 prior to the fastener 912 passing through the anchor-receiving passageway 972. In yet another example, the fastener 912, insert 940, washer 914, and bushing 916 may be aligned relative to the anchor-receiving passageway 972 prior to the windage shield 917 being aligned with the fan disk 913.

The fastener 912 engages the fastener retainer 918 to hold the windage shield 917 to the fan disk 913 as suggested in FIG. 25. The head 952 of the fastener 912 forces the washer 914 against the insert 940. The washer 914 forces the insert 940 against the pilot mount 927 of the windage shield 917. The insert 940 may include a groove 946 formed in an outer surface of the tube 942 adjacent to the flange 944. The groove 946 may allow the flange 944 to mate with the pilot mount 927. Tightening of the fastener 912 forces the washer 914 to contact the bushing 916 which forces the bushing 916 against the fan disk 913. The fastener 912 may then be further tightened to an operating tension to retain the windage shield 917 on the fan disk 913 during operation of the gas turbine engine 100.

Similar to component anchor 10, the component anchor 910 couples the windage shield 917 to the fan disk 913 while maintaining a substantially constant axial load on the windage shield 917 and low radial load on the component anchor 910. For example, at least some of the tension of the fastener 912 is placed on the bushing 916 instead of the windage shield 917 due to the distance $A_3$ between the windage shield 917 and fan disk 913 as suggested in FIG. 25. In another example, gaps $C_1$ and $D_1$ between the tube 942 of the insert 940 and sleeve 982 of the bushing 916 allow the windage shield 917 to expand and contract relative to the fan disk 913 without placing additional radial load on the fastener 912 of the component anchor 910.

Figure 27:
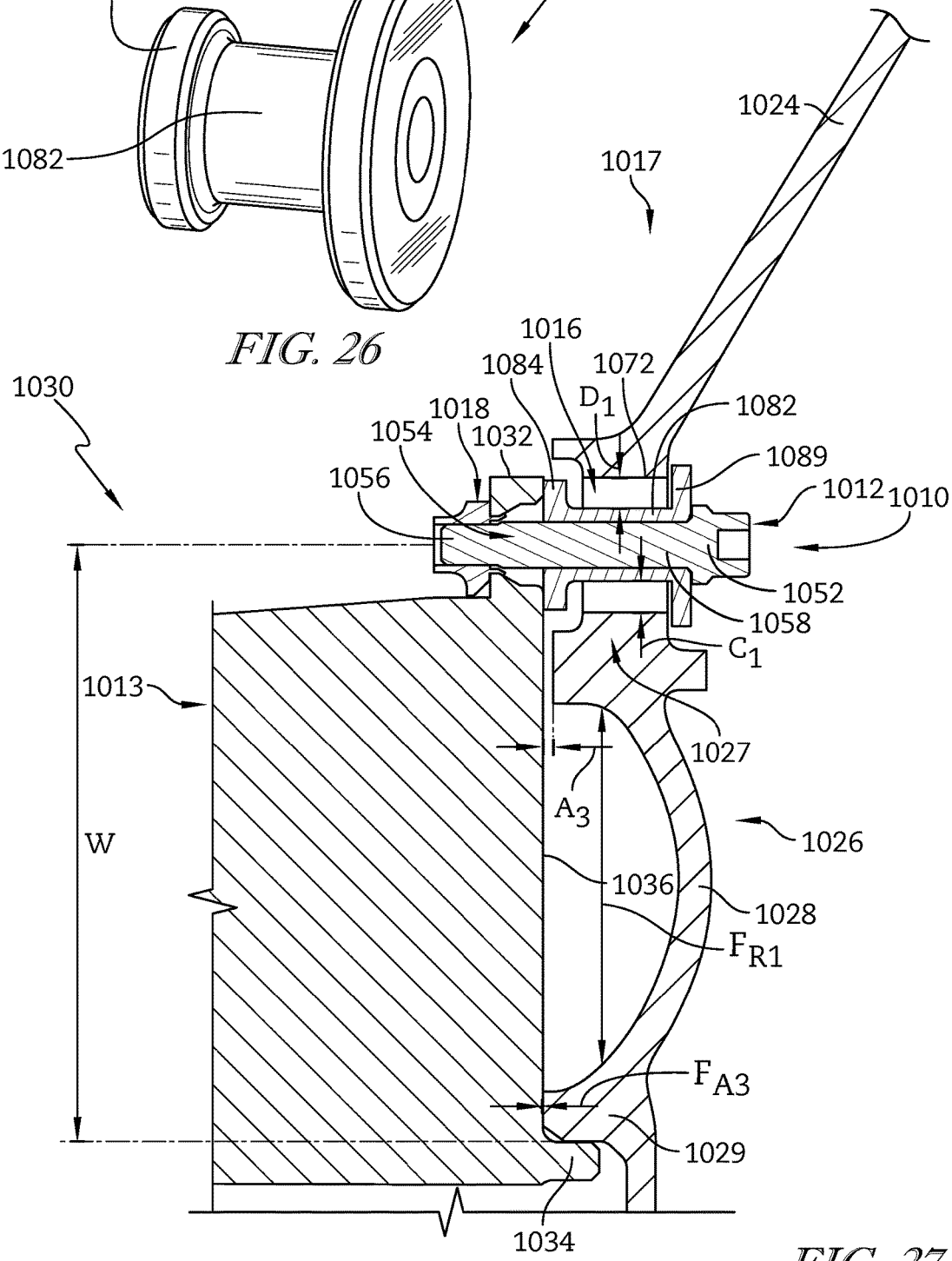
FIG. 27 is a cross-sectional view of another embodiment of an anchor in accordance with the present disclosure showing that the anchor includes, from left to right, a fastener retainer, the bushing of FIG. 26, and a fastener and suggesting that the stresses in the anchor are minimized as a result of several gaps being configured between portions of the windage shield and the anchor.

Another alternative arrangement for coupling a windage shield 1017 to a fan disk 1013 in a fan assembly 1030 is shown in FIG. 27. In the illustrative embodiment, a component anchor 1010 includes a fastener 1012, a bushing 1016, and a fastener retainer 1018. The component anchor 1010 is installed through an anchor-receiving passageway 1072 of the windage shield 1017 and a flange 1032 of the fan disk 1013.

The fastener 1012 includes a head 1052 and a shaft 1054 coupled to the head 1052 as suggested in FIG. 27. The shaft 1054 includes a substantially smooth neck section 1058 and an engagement section 1056 arranged to couple the fastener 1012 to the fastener retainer 1018. In the illustrative embodiment, the engagement section 1056 and fastener retainer 1018 are threaded. However, it should be noted that other arrangements for coupling the fastener 1012 with the fastener retainer 1018 are contemplated, such as a key, pin, spring clip, or other suitable alternative.

Figure 26:
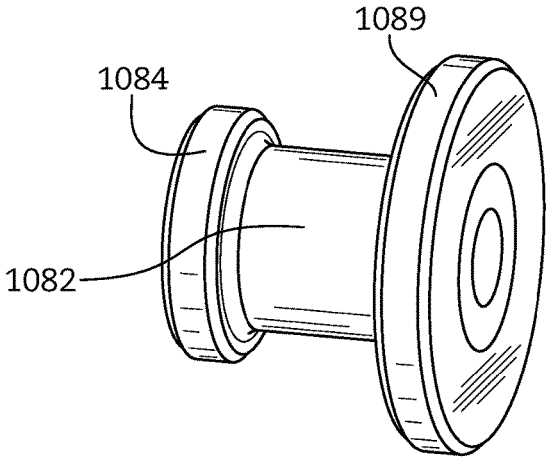
FIG. 26 is a perspective view of one embodiment of a bushing in accordance with the present disclosure.

The bushing 1016 includes a sleeve 1082, a contact flange 1084 coupled to one end of the sleeve 1082, and a coupler flange 1089 coupled to an opposing end of the sleeve 1082 as shown in FIGS. 26 and 27. The contact flange 1084 and sleeve 1082 have smaller diameters than an anchor-receiving passageway 1072 formed through a pilot mount 1027 of the windage shield 1017 such that the contact flange 1084 and sleeve 1082 may pass through the pilot mount 1027 to contact a flange 1032 of the fan disk 1013 as suggested in FIG. 27. The coupler flange 1089 has a larger diameter than the anchor-receiving passageway 1072 and is arranged to contact the pilot mount 1027 to hold the windage shield 1017 on the fan disk 1013.

A pilot unit 1026 of the windage shield 1017 includes the pilot mount 1027 coupled to a support wall 1024 of the windage shield 1017, a bias link 1028 coupled to the pilot mount 1027 and extending radially inward from the pilot mount 1027, and a pilot anchor 1029 coupled to the bias link 1028 as suggested in FIG. 27. The bias link 1028 may elastically deform during installation of the component anchor 1010 to force the pilot anchor 1029 against a pilot receiver 1034 of the fan disk 1013 with a force $F_{R1}$ and against the radially extending wall 1036 of the fan disk 113 with a force $F_{A3}$. The bias link 1028 maintains the pilot anchor 1029 at a substantially constant distance W from the component anchor 1010 during operation of the gas turbine engine 100.

The bias link 1028 assumes a generally curved shape with the curve extending away from the fan disk 1013 as suggested in FIG. 27. However, any other suitable shape may be used. The bias link 1028 may cooperate with the pilot anchor 1029 to maintain the pilot anchor 1029 in contact with a radially extending wall 1036 and pilot receiver 1034 of the fan disk 1013. The anchor 1010 couples the windage shield 1017 to the fan disk 1013 and the bias link 1028 maintains a constant deflection of the pilot anchor 1029 relative to the fan disk 1013 during operation of the gas turbine engine 100.

The fastener 1012 engages the fastener retainer 1018 to hold the windage shield 1017 to the fan disk 1013 as suggested in FIG. 27. The head 1052 of the fastener 1012 forces the coupler flange 1089 against the pilot mount 1027 of the windage shield 1017. Tightening of the fastener 1012 forces the contact flange 1084 of the bushing 1016 against the fan disk 1013. The fastener 1012 may then be further tightened to an operating tension to retain the windage shield 1017 on the fan disk 1013 during operation of the gas turbine engine 100.

Similar to component anchor 10, the component anchor 1010 couples the windage shield 1017 to the fan disk 1013 while maintaining a substantially constant axial load on the windage shield 1017 and low radial load on the component anchor 1010. For example, at least some of the tension of the fastener 1012 is placed on the bushing 1016 instead of the windage shield 1017 due to the distance $A_3$ between the windage shield 1017 and fan disk 1013 as suggested in FIG. 27. In another example, gaps $C_1$ and $D_1$ between the anchor-receiving passageway 1072 and sleeve 1082 of the bushing 1016 allow the windage shield 1017 to expand and contract relative to the fan disk 1013 without placing additional radial load on the fastener 1012 of the component anchor 1010. In some embodiments, an insert, similar to insert 940 shown in FIGS. 24 and 25, may be used with component anchor 1010.

Figure 28:
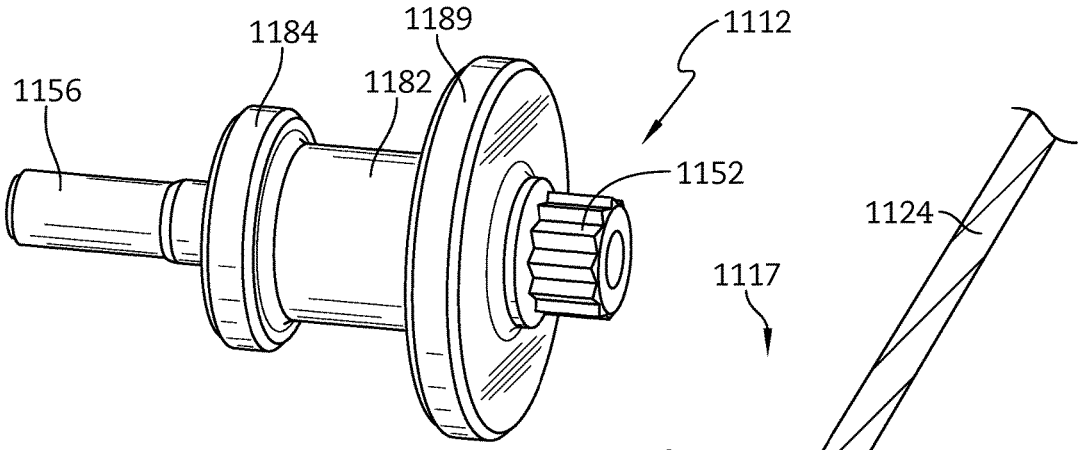
FIG. 28 is a perspective view of one embodiment of a fastener in accordance with the present disclosure.
Figure 29:
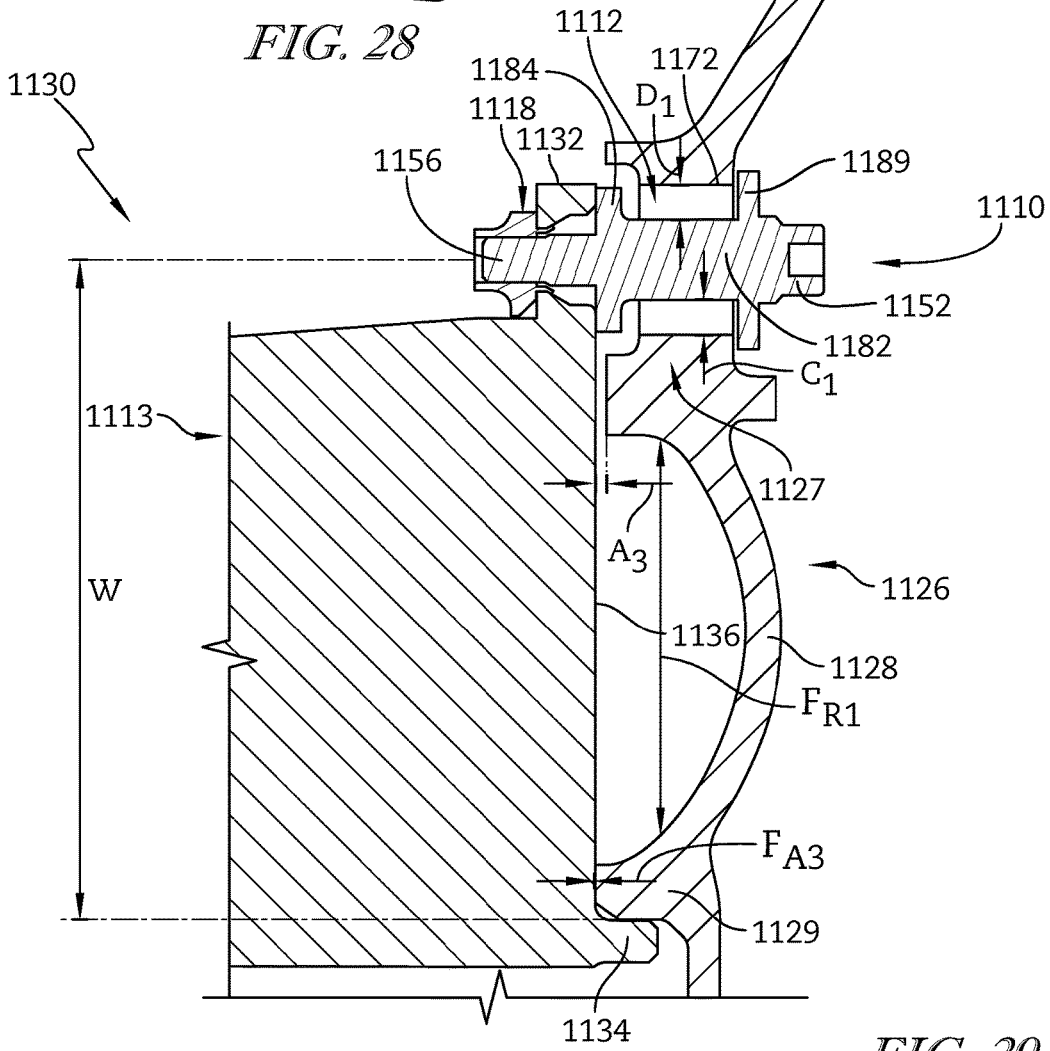
FIG. 29 is a cross-sectional view of another embodiment of an anchor in accordance with the present disclosure showing that the anchor includes, from left to right, a fastener retainer and the fastener of FIG. 28, and suggesting that the stresses in the anchor are minimized as a result of several gaps being configured between portions of the windage shield and the anchor.

Another alternative arrangement for coupling a windage shield 1117 to a fan disk 1113 in a fan assembly 1130 is shown in FIG. 29. In the illustrative embodiment, a component anchor 1110 includes a fastener 1112 and a fastener retainer 1118. The component anchor 1110 is installed through the windage shield 1117 and fan disk 1113. The fastener 1112 includes a barrel section 1182, a head 1152 coupled to one end of the barrel section 1182, and an engagement section 1156 coupled to an opposing end of the barrel section 1182 as shown in FIGS. 28 and 29. The engagement section 1156 is arranged to couple the fastener 1112 to the fastener retainer 1118. In the illustrative embodiment, the engagement section 1156 and fastener retainer 1118 are threaded. However, it should be noted that other arrangements for coupling the fastener 1112 with the fastener retainer 1118 are contemplated, such as a key, pin, spring clip, or other suitable alternative.

The fastener 1112 further includes a contact flange 1184 coupled to the barrel section 1182 and a coupler flange 1189 coupled to the barrel section 1182 and spaced apart from the contact flange 1184 as shown in FIGS. 28 and 29. The contact flange 1184 and barrel section 1182 have smaller diameters than an anchor-receiving passageway 1172 formed through a pilot mount 1127 of the windage shield 1117 such that the contact flange 1184 and barrel section 1182 may pass through the pilot mount 1127 to contact a flange 1132 of the fan disk 1113 as suggested in FIG. 29. The coupler flange 1189 has a larger diameter than the anchor-receiving passageway 1172 and is arranged to contact the pilot mount 1127 to hold the windage shield 1117 on the fan disk 1113.

A pilot unit 1126 of the windage shield 1117 includes the pilot mount 1127 coupled to a support wall 1124 of the windage shield 1117, a bias link 1128 coupled to the pilot mount 1127 and extending radially inward from the pilot mount 1127, and a pilot anchor 1129 coupled to the bias link 1128 as suggested in FIG. 29. The bias link 1128 may elastically deform during installation of the component anchor 1110 to force the pilot anchor 1129 against a pilot receiver 1134 of the fan disk 1113 with a force $F_{R1}$ and against the radially extending wall 1136 of the fan disk 113 with a force $F_{A3}$. The bias link 1128 maintains the pilot anchor 1129 at a substantially constant distance W from the component anchor 1110 during operation of the gas turbine engine 100.

The bias link 1028 assumes a generally curved shape with the curve extending away from the fan disk 1013 as suggested in FIG. 29. However, any other suitable shape may be used. The bias link 1028 may cooperate with the pilot anchor 1029 to maintain the pilot anchor 1029 in contact with a radially extending wall 1036 and pilot receiver 1034 of the fan disk 1013. The anchor 1010 couples the windage shield 1017 to the fan disk 1013 and the bias link 1028 maintains a constant deflection of the pilot anchor 1029 relative to the fan disk 1013 during operation of the gas turbine engine 100.

The fastener 1112 engages the fastener retainer 1118 to hold the windage shield 1117 to the fan disk 1113 as suggested in FIG. 29. The head 1152 of the fastener 1112 forces the coupler flange 1189 against the pilot mount 1127 of the windage shield 1117. Tightening of the fastener 1112 forces the contact flange 1184 of the fastener 1112 against the fan disk 1113. The fastener 1112 may then be further tightened to an operating tension to retain the windage shield 1117 on the fan disk 1113 during operation of the gas turbine engine 100.

Similar to component anchor 10, the component anchor 1110 couples the windage shield 1117 to the fan disk 1113 while maintaining a substantially constant axial load on the windage shield 1117 and low radial load on the component anchor 1110. For example, at least some of the tension of the fastener 1112 is placed on the fastener 1112 instead of the windage shield 1117 due to the distance $A_3$ between the windage shield 1117 and fan disk 1113 as suggested in FIG. 29. In another example, gaps $C_1$ and $D_1$ between the anchor-receiving passageway 1172 and barrel section 1182 of the fastener 1112 allow the windage shield 1117 to expand and contract relative to the fan disk 1113 without placing additional radial load on the fastener 1112 of the component anchor 1110. In some embodiments, an insert, similar to insert 940 shown in FIGS. 24 and 25, may be used with component anchor 1110.

What is claimed is:

1. A gas turbine engine comprising a first component formed to include a first anchor-receiving space therein, the first anchor-receiving space being arranged to extend along an installation axis through a portion of the first component, a second component coupled to the first component to move therewith, the second component being formed to include a second anchor-receiving space therein, and the second anchor-receiving space is arranged to extend along the installation axis through the second component and be aligned with the first anchor-receiving space, and an anchor arranged to interconnect and couple the first component to the second component in continuous compressive engagement with each other, the anchor including a bushing located in the second anchor-receiving space and arranged to extend out of the second anchor-receiving space toward the first component to engage the first component, a washer positioned to engage the bushing along the installation axis to locate the second anchor-receiving space between the washer and the first component, a fastener arranged to extend through a fastener-receiving aperture formed in the washer, through a fastener-receiving space formed in the bushing, and through the first anchor-receiving space, and a fastener retainer coupled to the fastener to block movement of the fastener relative to the first and second components while locating the second component and the bushing between the fastener retainer and the washer, wherein the washer is in continuous engagement with the second component, wherein the anchor is configured to minimize stress formed in the fastener during operation of the gas turbine engine as a result of the first component having a different thermal or mechanical expansion rate than the second component.

2. The gas turbine engine of claim 1, wherein the anchor is further configured to minimize fretting between the first component and the second component during operation of the gas turbine engine as a result of the first component having a different thermal or mechanical expansion rate than the second component.

3. The gas turbine engine of claim 2, wherein a portion of the second component is formed to include the second anchor-receiving space and the portion of the second component is spaced apart axially from the first component.

4. The gas turbine engine of claim 3, wherein a thickness of the portion of the second component is smaller than a length of the bushing such that the portion of the second component is spaced apart from the first component when the second component is coupled to the first component.

5. The gas turbine engine of claim 2, wherein the anchor further includes an insert located in the second anchor-receiving space and arranged to engage the second component, the insert including a bushing-receiving space and a washer-engaging surface, the bushing-receiving space arranged to surround an outer surface of the bushing and the washer-engaging surface positioned to engage the washer to space the washer from the second component.

6. The gas turbine engine of claim 5, wherein the bushing-receiving space is defined by an inner surface arranged to face toward the installation axis and the outer surface of the bushing is spaced-apart from the inner surface by a first distance when the gas turbine engine is at a cold temperature.

7. The gas turbine engine of claim 6, wherein the outer surface of the bushing is spaced-apart from the inner surface by a relatively smaller second distance when the gas turbine engine is at a relatively greater operational temperature.

8. The gas turbine engine of claim 7, wherein the outer surface of the bushing is spaced-apart from the inner surface by a third distance relatively smaller than the first distance while the gas turbine engine transitions from the operational temperature to the cold temperature.

9. The gas turbine engine of claim 2, wherein the bushing includes a sleeve arranged to pass into the second anchor-receiving space of the second component and a flange coupled to the sleeve and arranged to contact the first component, the second component further includes a recess formed into the second component at one end of the second anchor-receiving space, and the recess is sized and arranged to surround the flange of the bushing.

10. The gas turbine engine of claim 1, wherein the second anchor-receiving space is defined by an inner surface arranged to face toward the installation axis and an outer surface of the bushing is spaced-apart from the inner surface by a first distance when the gas turbine engine is at a cold temperature.

11. The gas turbine engine of claim 10, wherein the outer surface of the bushing is spaced-apart from the inner surface by a relatively smaller second distance when the gas turbine engine is at a relatively greater operational temperature and the outer surface of the bushing is spaced-apart from the inner surface by a third distance relatively smaller than the first distance while the gas turbine engine transitions from the operational temperature to the cold temperature.

12. The gas turbine engine of claim 1, wherein the bushing and the washer are formed as a single unitary component.

13. The gas turbine engine of claim 12, wherein the bushing, the washer, and the fastener are formed as a single unitary component.

14. A gas turbine engine comprising a fan disk arranged to hold a plurality of fan blades for rotation about a central axis of the gas turbine engine, the fan disk formed to include a first anchor-receiving space therein arranged to extend along an installation axis through a portion of the fan disk, a windage shield arranged to guide incoming air provided by the fan blades through the gas turbine engine, the windage shield coupled to the fan disk to move therewith and being formed to include a second anchor-receiving space therein, the second anchor-receiving space being arranged to extend along the installation axis through the windage shield and be aligned with the first anchor-receiving space, and an anchor arranged to interconnect and couple the windage shield to the fan disk in continuous compressive engagement with each other, the anchor including a bushing having a sleeve located in the second anchor-receiving space and a flange coupled to the sleeve arranged to extend out of the second anchor- space toward the fan disk to engage the fan disk, a washer positioned to engage the bushing along the installation axis to locate the second anchor-receiving space between the washer and the fan disk, a fastener arranged to extend through a fastener-receiving aperture formed in the washer, through a fastener-receiving space formed in the bushing, and through the first anchor-receiving space, and a fastener retainer coupled to the fastener to block movement of the fastener relative to the fan disk and windage shield while locating the windage shield and the bushing between the fastener retainer and the washer, wherein the washer is in continuous compressive engagement with the windage shield, wherein a length of the bushing is longer than a length of the second anchor-receiving space and a diameter of the sleeve is smaller than a diameter of the second anchor-receiving space such that the second anchor-receiving space is spaced apart from the fan disk and the sleeve is spaced apart from an inner surface of the second anchor-receiving space to allow the windage shield to expand and contract relative to the fan disk while minimizing stresses in the fastener during operation of the gas turbine engine.

15. The gas turbine engine of claim 14, wherein the anchor further includes an insert, the insert including a tube located in the second anchor-receiving space and a flange coupled to the tube and arranged to engage the windage shield and extend out of the second anchor-receiving space toward the washer to engage the washer, and wherein a length of the bushing is longer than a length of the second anchor-receiving space and an outer diameter of the sleeve is smaller than an inner diameter of the tube such that the second anchor-receiving space is spaced apart from the fan disk and the sleeve is spaced apart from an inner surface of the tube to allow the windage shield to expand and contract relative to the fan disk while minimizing stresses in the fastener during operation of the gas turbine engine.

16. The gas turbine engine of claim 15, wherein the outer surface of the sleeve is spaced-apart from the inner surface of the tube by a first distance when the gas turbine engine is at a cold temperature, wherein the outer surface of the sleeve is spaced-apart from the inner surface of the tube by a relatively smaller second distance when the gas turbine engine is at a relatively greater operational temperature, and wherein the outer surface of the sleeve is spaced apart from the inner surface of the tube by a third distance relatively smaller than the first distance while the gas turbine engine transitions from the operational temperature to the cold temperature.

* * * * *